US007151518B2

(12) United States Patent
Fukumoto et al.

(10) Patent No.: US 7,151,518 B2
(45) Date of Patent: Dec. 19, 2006

(54) LIQUID CRYSTAL DISPLAY DEVICE AND DRIVING METHOD OF THE SAME

(75) Inventors: Tohko Fukumoto, Mobara (JP); Yoshihiro Imajo, Mobara (JP); Nobuhiro Takeda, Mobara (JP)

(73) Assignee: Hitachi, Ltd., Tokyo (JP)

( * ) Notice: Subject to any disclaimer, the term of this patent is extended or adjusted under 35 U.S.C. 154(b) by 204 days.

(21) Appl. No.: 10/214,602

(22) Filed: Aug. 9, 2002

(65) Prior Publication Data

US 2003/0048248 A1 Mar. 13, 2003

(30) Foreign Application Priority Data

Sep. 13, 2001 (JP) ..... 2001-277799

(51) Int. Cl.
*G09G 3/36* (2006.01)
*G09G 5/00* (2006.01)

(52) U.S. Cl. ..... 345/96; 345/209

(58) Field of Classification Search ..... 345/94–96, 345/690, 691, 87–89, 55, 92, 208–210, 54
See application file for complete search history.

(56) References Cited

U.S. PATENT DOCUMENTS 4,626,841 A * 12/1986 Togashi ..... 345/210
5,184,118 A * 2/1993 Yamazaki ..... 345/96
5,606,342 A * 2/1997 Shoji et al. ..... 345/94
5,724,057 A 3/1998 Kimura
5,892,494 A * 4/1999 Kimura et al. ..... 345/96
6,219,019 B1 * 4/2001 Hasegawa et al. ..... 345/96
6,456,268 B1 * 9/2002 Takeda ..... 345/92
6,501,455 B1 12/2002 Nakamura
6,549,187 B1 4/2003 Matsubara
6,549,196 B1 * 4/2003 Taguchi et al. ..... 345/210
6,670,935 B1 * 12/2003 Yeon et al. ..... 345/89
6,727,878 B1 * 4/2004 Okuzono et al. ..... 345/96
2001/0020929 A1 9/2001 Nagata et al.
2002/0024482 A1 * 2/2002 Song et al. ..... 345/87

(Continued)

FOREIGN PATENT DOCUMENTS

CN 1313519 A 9/2001

(Continued)

OTHER PUBLICATIONS

Japanese Patent Laid open Publication No. Hei 9-15560 (Published Jan. 17, 1997) & Patent Abstracts of Japan (in English) (*Additional Explanation*) This document is explained in our specification.

*Primary Examiner*—Richard Hjerpe
*Assistant Examiner*—Kevin M. Nguyen
(74) *Attorney, Agent, or Firm*—Antonelli, Terry, Stout and Kraus, LLP.

(57) ABSTRACT

In the method for driving a liquid crystal display device which has a plurality of picture elements or "pixels" and a drive circuit for outputting to each pixel a gradation voltage selected from among M (M≧2) gradation voltages, the polarity of a gradation voltage that is outputted from the drive circuit to each pixel is inverted for every N (N≧2)-line group, while letting the voltage value of an m (1≧m≧M)-th gradation voltage to be outputted from the drive circuit to each pixel be different between the time when outputting it to the pixels on the first line immediately after the polarity inversion and the time when outputting it to the pixel on a line which is subsequent to the first line, immediately after the polarity inversion, and whose polarity is not inverted.

34 Claims, 25 Drawing Sheets

U.S. PATENT DOCUMENTS

2003/0058375 A1 3/2003 Moon

FOREIGN PATENT DOCUMENTS

| | | |
|---|---|---|
| CN | 1347072 A | 5/2002 |
| JP | 7-129127 | 5/1995 |
| JP | 11-271716 | 10/1999 |
| JP | 2000-29440 | 1/2000 |
| JP | 2001-13480 | 1/2001 |
| KR | 2001-0007438 | 10/2001 |

* cited by examiner

ODD FRAME

EVEN FRAME

LIQUID CRYSTAL DISPLAY DEVICE AND DRIVING METHOD OF THE SAME

BACKGROUND OF THE INVENTION

The present invention relates generally to liquid crystal display devices and to methods of driving such devices. More particularly, but not exclusively, this invention relates to techniques that are effective for use with drive methods for inverting the polarity of gradation voltages that are applied to picture elements or "pixels" in groups of a plurality of lines as a unit, such as N-line inversion drive methods.

Liquid crystal display devices of the active matrix type, having switching-driven active elements (e.g. thin-film transistors) for each pixel, are widely used as display devices for use in personal computers (hereinafter referred to as PCs), including notebook PCs.

As one example of the active-matrix type of liquid crystal display devices, a TFT (Thin Film Transistor) type liquid crystal display module is known. This module includes a T19' type liquid crystal display (TFT-LCD) panel, drain drivers disposed along the long side of the liquid crystal display panel, and gate drivers or an interface unit disposed along the short side of the panel.

Generally, the drain driver internally has a gradation voltage generating circuit, which generates a gradation voltage to be supplied to the pixels of the LCD panel based on a plurality of gradation reference voltages supplied from the interface unit.

Generally, a layer of liquid crystal material is characterized in that, when the same voltage (DC voltage) is applied thereto for an increased length of time, the inclination of such liquid crystal becomes fixed, resulting in occurrence of an after-image or "ghost" phenomenon. This leads to a decrease in the lifetime of the liquid crystal layer. In order to avoid this problem, the liquid crystal display module is arranged so that a voltage to be applied to the liquid crystal layer is converted into an AC voltage periodically; that is, relative to the common voltage to be applied to a common electrode (shared electrode), the gradation voltage to be applied to a pixel electrode is alternately changed in polarity between the positive voltage side and the negative voltage side at constant time intervals.

Drive methodology for applying the AC voltage to the liquid crystal layer includes two known methods: a common symmetry method and a common inversion method. The common inversion method is a method which alternately inverts the common voltage being applied to a common electrode and the gradation voltage being applied to a pixel electrode between positive and negative polarities. The common symmetry method is a method in which the common voltage as applied to a common electrode is kept constant, and the gradation voltage being applied to a pixel electrode is inverted so that it alternately takes positive and negative polarities with reference to the common voltage to be applied to a common electrode.

FIG. 30 is a diagram illustrating the polarity of a gradation voltage (i.e. the gradation voltage to be applied to a pixel electrode) which is outputted from a drain driver to a drain signal line in the case of using a dot inversion method as the liquid crystal display module drive method.

With the dot inversion method, as shown in FIG. 30, at an odd-numbered line in an odd-numbered frame, for example, a gradation voltage (indicated by "•" in FIG. 30), having a negative polarity relative to the common voltage (Vcom) being applied to the common electrode, is applied from a drain driver to an odd-numbered drain signal line; whereas, a gradation voltage (indicated by "○" in FIG. 30), having a positive polarity relative to the common voltage (Vcom) being applied to the common electrode, is applied to an even-numbered drain signal line. Further, at an even-numbered line in an odd-numbered frame, a positive gradation voltage is applied from the drain driver to an odd-numbered drain signal line, and a negative gradation voltage is applied to an even-numbered drain signal line.

In addition, the polarity per each line is inverted for each frame. More specifically, as shown in FIG. 30, at an odd-numbered line of an even-numbered frame, a positive gradation voltage is applied from the drain driver to an odd-numbered drain signal line, and a negative gradation voltage is applied to an even-numbered drain signal line. Further, at an even-numbered line of the even-numbered frame, a negative gradation voltage is applied from the drain driver to an odd-numbered drain signal line, and a positive gradation voltage is applied to an even-numbered drain signal line.

By use of this dot inversion method, the voltages that are applied to neighboring drain signal lines are opposite in polarity to each other. Thus, it is possible to permit adjacent ones of the currents flowing in common electrodes and/or the gate electrodes of thin-film transistors (TFT) to cancel each other, thereby enabling a reduction of the electrical power consumption.

In addition, the common electrode-flowing current remains lower in level, preventing a voltage drop-down from becoming greater. Thus, the common electrode is stabilized in voltage level, enabling minimization of a decrease in on-screen display quality.

However, currently available PCs with a built-in liquid crystal display module, which employs the above-described dot inversion method, are faced with a problem, as follows. Flickers (flicking noises) can occur on the display screen of a liquid crystal display panel in cases where a specified relationship is present between the timing of AC voltage conversion and an image pattern to be visually displayed (e.g. Windows® exit screen or else), which would result in a decrease in display quality.

This problem is solvable by employing, as the drive method, an N-line (e.g. two-line) inversion method, which inverts the polarity of a gradation voltage being applied from a drain driver to a drain signal line for each N lines (e.g. two lines).

However, in the case of employing such N-line (e.g. 2-line) inversion method as the drive method, there has been a problem, as follows. A pattern of lateral stripes with a pitch equal to N lines appears on the display screen when displaying a single-colored monotone image on the entire display screen, as shown in FIG. 31. This causes a significant decrease in the display quality of the liquid crystal display panel.

The present invention has been made in order to avoid the problems of the prior art as described above, and an object of this invention is to provide a technique that is adaptable for use in a liquid crystal display device and a driving method thereof, which technique serves to avoid unwanted creation of a lateral stripe-like "ghost" pattern on a display screen when inverting the polarity of a gradation voltage for each group of N lines ($N \geqq 2$), to thereby achieve an increase in the on-screen image display quality.

The above object and new features of the invention will be apparent from the following more detached description of preferred embodiments of the invention, as illustrated in the accompanying drawings.

SUMMARY OF THE INVENTION

A brief explanation of some representative ones of the inventive concepts as disclosed herein is as follows.

In accordance with one aspect of the present invention, a principal feature in a technique in which in that the polarity of a gradation voltage to be outputted from a drive circuit to each pixel is inverted for each N lines ($N \geqq 2$) while at the same time letting the voltage value of an m ($1 \leqq m \leqq M$)-th gradation voltage being outputted from the drive circuit to each pixel be different between when it is outputted to the pixel on a first line immediately after the polarity inversion and when it is outputted to the pixel on a polarity-noninverted line subsequent to the first line immediately after the polarity inversion.

As an example, the absolute value of a difference between the m-th gradation voltage being outputted from the drive circuit to each pixel and a common voltage is made greater when outputting a gradation voltage from the drive circuit to the pixel on the first line immediately after the polarity inversion, than when outputting a gradation voltage from the drive circuit to the pixel on the polarity-noninverted line.

In accordance with another aspect of this invention, the absolute value of a difference between the gradation voltage to be outputted from the drive circuit to the pixel on the first line immediately after the polarity inversion and the gradation voltage to be outputted from the drive circuit to the pixel on the polarity-noninverted line is made different for each gradation level.

In accordance with still another aspect of the invention, the absolute value of a difference between the gradation voltage to be outputted from the drive circuit to the pixel on the first line immediately after the polarity inversion and the gradation voltage to be outputted from the drive circuit to the pixel on the polarity-noninverted line is specifically arranged to become greater with an increase in the absolute value of a difference between the gradation voltage and the common voltage.

In accordance with yet another aspect of the invention, the absolute value of a difference between the m-th gradation voltage to be outputted from the drive circuit to the pixel on the first line immediately after the polarity inversion and the m-th gradation voltage to be outputted from the drive circuit to the pixel on the polarity-noninverted line is arranged to increase with an increase in distance between a presently scanned line and the drive circuit.

In accordance with a further aspect of the invention, in order to make the voltage value of the m ($1 \leqq m \leqq M$)-th gradation voltage to be outputted from the drive circuit to each pixel different between the time when it is outputted to the pixel on the first line immediately after the polarity inversion and when it is outputted to the pixel on the polarity-noninverted line subsequent to the first line immediately after the polarity inversion, the voltage value of a k ($1 \leqq k \leqq K$)-th gradation reference voltage to be supplied from a power supply circuit to the drive circuit is allowed to differ between when outputting a gradation voltage from the drive circuit to the pixel on the first line immediately after the polarity inversion and when outputting a gradation voltage from the drive circuit to the pixel on the polarity-noninverted line subsequent to the first line immediately after the polarity inversion.

In accordance with another aspect of the invention, a horizontal scanning time period of the line is arranged so that this period is different between when outputting a gradation voltage from the drive circuit to the pixel on the first line immediately after the polarity inversion and when outputting a gradation voltage from the drive circuit to the pixel on the polarity-noninverted line.

With use of the above-noted means, it is possible to equalize a voltage to be written into the pixel on the line immediately after the polarity inversion to a voltage to be written into the pixel on another line that is subsequent to the line immediately after the polarity inversion, which in turn makes it possible to prevent creation of lateral stripes on the display screen of a liquid crystal display device, thus enabling achievement of an improved display quality of such display screen. Note that the language "subsequent to" as used herein is to be understood to mean "next to" or "following" or "the following".

DESCRIPTION OF THE PREFERRED EMBODIMENTS

Figure 1:
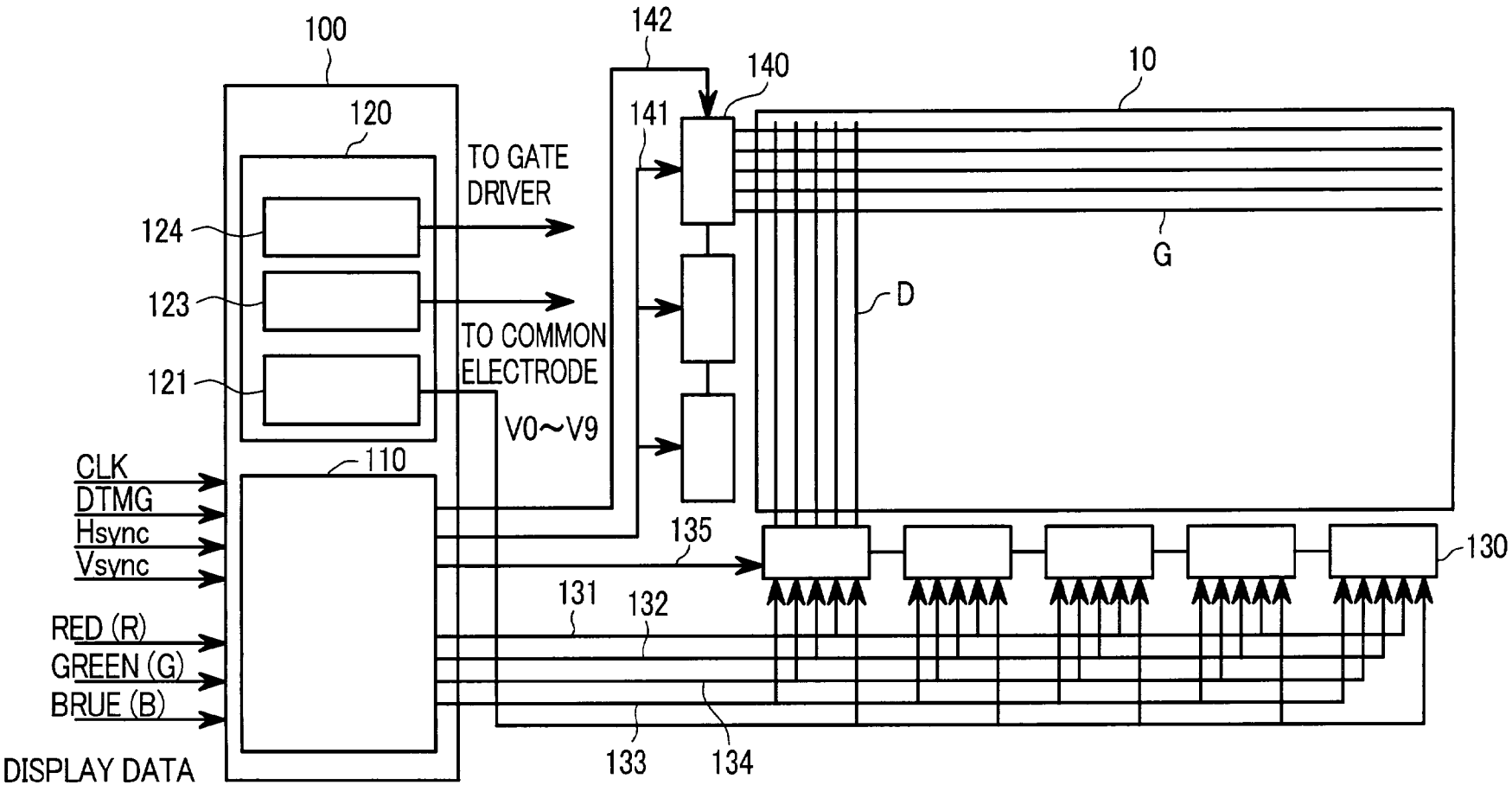
FIG. 1 is a block diagram schematically showing an arrangement of a liquid crystal display module of the TFT type, to which the present invention is applied.

Preferred embodiments of the present invention will be described in detail with reference to the accompanying drawings.

It should be noted that, in all of the drawings which illustrate the preferred embodiments of the invention, parts having the same function are denoted by the same reference characters, and any repetitive description thereof is omitted herein.

Embodiment 1

<Basic Arrangement of TFT Type Liquid Crystal Display Module Embodying the Invention>

FIG. 1 is a block diagram schematically showing the overall configuration of a liquid crystal display module of the TFT type, embodying the features of the present invention.

The liquid crystal display module (LCM) shown in FIG. 1 includes a TFT-type liquid crystal display (TFT-LCD) panel 10, with drain drivers 130 disposed along its long sides and with gate drivers 140 laid out along short sides of the liquid crystal display panel 10. These drain drivers 130 and gate drivers 140 are directly mounted on one of the glass substrates (e.g. TFT substrate) of the liquid crystal display panel 10 at peripheral portions thereof.

An interface unit 100 is mounted on an interface substrate, which in turn is mounted on a rear side of the liquid crystal display panel 10.

<Arrangement of Liquid Crystal Display Panel 10 Shown in FIG. 1>

Figure 2:
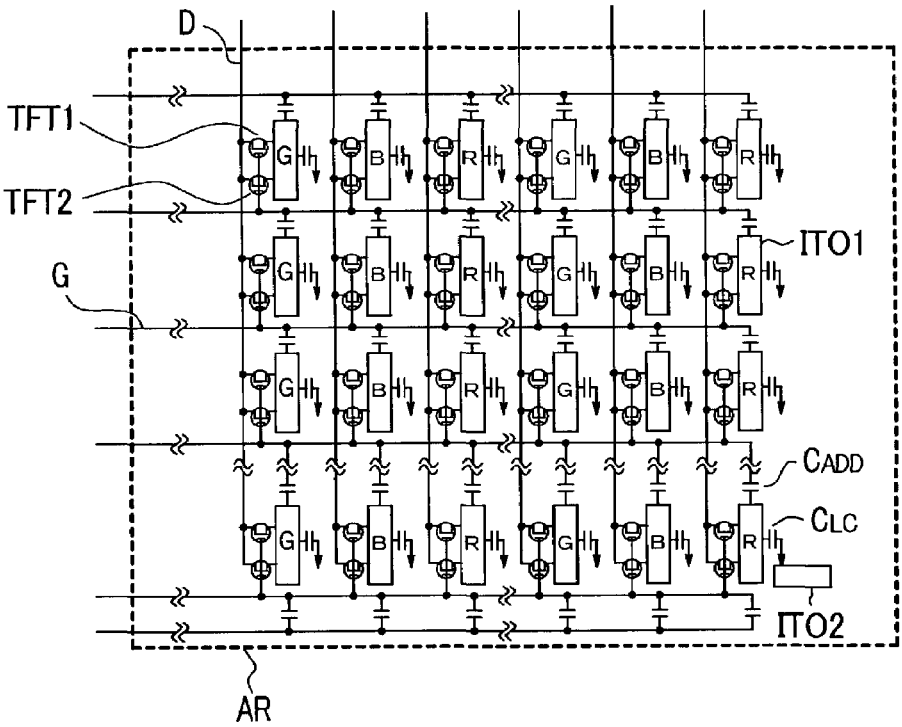
FIG. 2 is a diagram showing one exemplary equivalent circuit of the liquid crystal display panel shown in FIG. 1.

FIG. 2 is a diagram showing an exemplary equivalent circuit of the liquid crystal display panel 10 shown in FIG. 1. As shown in FIG. 2, the liquid crystal display panel 10 has a plurality of "pixels", which are formed into a matrix array. Each pixel is disposed within an area or "intersection" region of two neighboring signal lines (drain signal lines (D) or gate signal lines (G)) and two adjacent signal lines (gate signal lines (G) or drain signal lines (D)). Each pixel also has thin-film transistors (TFT1, TFT2) having source electrodes connected to a pixel electrode (ITO1).

Since a layer of liquid crystal material is provided between the pixel electrode (ITO1) and a common electrode (ITO2), a liquid crystal capacitance (CLC) is equivalently connected between the pixel electrode (ITO1) and the common electrode (1T02). Further, an additional capacitance (CADD) is connected between the source electrodes of thin-film transistors (TFT1, TFT2) and a gate signal line (G) at its pre-stage.

Figure 3:
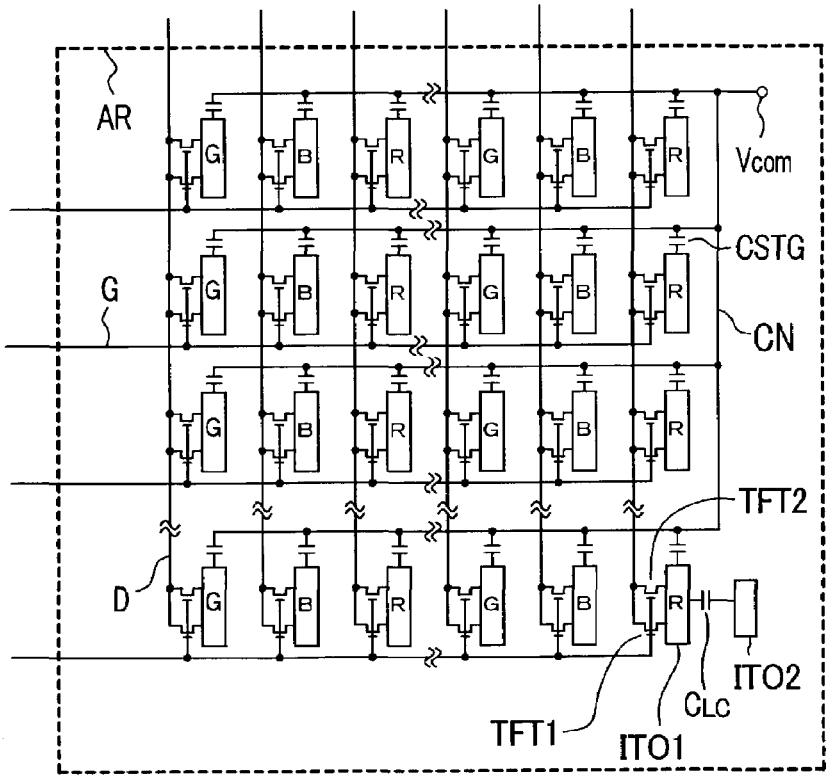
FIG. 3 is a diagram showing another exemplary equivalent circuit of the liquid crystal display panel shown in FIG. 1.

FIG. 3 is a diagram showing an equivalent circuit of another example of the liquid crystal display panel 10 shown in FIG. 1. Although, in the example shown in FIG. 2, an additional capacitance (CADD) is formed between the pre-stage gate signal line (G) and the source electrodes, the equivalent circuit shown in FIG. 3 is different therefrom in that a storage capacitance (CSTG) is formed between a common signal line (CN), to which a common voltage (Vcom) is applied, and the source electrodes. This invention is applicable to both configurations.

Note that FIGS. 2 and 3 show equivalent circuits of a liquid crystal display panel of the longitudinal electric field type, wherein "AR" is used to designate a display area in FIGS. 2 and 3. In addition, although FIGS. 2 and 3 are circuit diagrams, the elements are depicted therein in a way corresponding to the actual geometrical layout of the respective elements.

In the liquid crystal display panels 10 shown in FIGS. 2 and 3, the thin-film transistors (TFT1, TFT2) of each of the pixels, as disposed in a column direction, have drain electrodes which are connected to respective drain signal lines (D). Each drain signal line (D) is connected to a drain driver 130 for applying a gradation voltage to the liquid crystal material of each pixel in the column direction.

Additionally, gate electrodes of the thin-film transistors (TFT1, TFT2) in each pixel disposed in a row direction are connected to respective gate signal lines (G), wherein each gate signal line (G) is connected to a gate driver 140, which supplies a scan drive voltage (positive bias voltage or negative bias voltage) to the gate electrodes of the thin-film transistors (TFT1, TFT2) of each pixel in the row direction within a single horizontal scan time period.

<Arrangement and Operation of Interface Unit 100 Shown in FIG. 1>

The interface unit 100 shown in FIG. 1 is generally constituted from a display control device 110 and a power supply circuit 120.

The display control device 110 is formed of a single semiconductor integrated circuit (such as an LSI chip), which controls and drives the drain drivers 130 and gate drivers 140 based on signals sent from the computer main body side, which signals include display data (R.G.B) and respective display control signals, such as clock signals (CLK), a display timing signal (DTMG), a horizontal synchronize signal (Hsync), and a vertical synchronize signal (Vsync).

Upon receipt of the display timing signal DTMG, the display control device 110 uses this signal to determine a display start-up position and then outputs a start pulse (display data accept start signal) to a first drain driver 130 through a signal line 135 and further outputs a simple single array of display data thus received to the drain drivers 130 via a display data bus line 133. In this event, the display control device 110 outputs, via a signal line 131, a display data latch-use clock (CL2) (simply referred to as "clock (CL2)" hereinafter), which is a display control signal used to latch display data in a data latch circuit of each drain driver 130.

The display data from the main-body computer side may be transferred in a way such that 6 bits of data make up a single pixel unit—that is, respective data of red (R), green (G) and blue (B) are combined together into a single set—and are sent forth on a per-pixel basis for every unit time, by way of example.

Additionally, a latch operation of the data latch circuit in the first drain driver 130 is controlled by the start pulse inputted to the first drain driver 130. Upon termination of the latch operation of the data latch circuit at this first drain driver 130, the start pulse is inputted from the first drain driver 130 to a second drain driver 130, whereby a latch operation of the data latch circuit in the second drain driver 130 is controlled. Thereafter, a latch operation of the data latch circuit at each drain driver 130 is controlled in a similar way to that stated above, thereby preventing erroneous display data from being written into the data latch circuits.

Upon termination of inputting of the display timing signal, or, alternatively, when a prespecified length of time has elapsed since the display timing signal was inputted, the display control device 110 determines that the display data corresponding to one horizontal period has expired and then outputs an output timing control clock (CL1) (referred to simply as "clock (CL1)" hereinafter) to each drain driver 130 via a signal line 132, wherein the clock (CL1) is a display control signal which is used to output the display data that has been stored at the data latch circuit in each drain driver 130 toward the drain signal line (D) of the liquid crystal display panel 10.

Additionally, upon input of a first display timing signal after the input of a vertical synchronizing signal, the display control device 110 recognizes this as a first display line and then outputs a frame start instruction signal (FLM) to the gate driver(s) 140 via a signal line 142. Furthermore, the display control device 110, based on a horizontal synchronizing signal, outputs a clock signal (CL3) which is a shift clock of one horizontal scan time period to the gate driver(s) 140 via a signal line 141 in such a way as to sequentially apply a positive bias voltage to the respective gate signal lines (G) of the liquid crystal display panel 10, for each horizontal scan time.

In this way, a plurality of thin-film transistors (TFT), that are connected to each gate signal line (G) of the liquid crystal display panel 10, are driven so as to be turned on within a single horizontal scan time.

With the operation described above, an image is visually displayed on the liquid crystal display panel 10.

<Arrangement of Power Supply Circuit 120 Shown in FIG. 1>

The power supply circuit 120 shown in FIG. 1 is made up of a gradation reference voltage generating circuit 121, a common electrode (opposite or "counter" electrode) voltage generation circuit 123, and a gate electrode voltage generation circuit 124.

The gradation reference voltage generator circuit 121 is configured from a serial-resistor voltage divider circuit, which outputs gradation reference voltages (V0 to V9) of ten different values. These gradation reference voltages (V0 to V9) are supplied to each drain driver 130. Additionally, an AC-converted signal (AC-converted timing signal denoted by "M") from the display control device 110 is also supplied to each drain driver 130 via a signal line 134.

The common electrode voltage generator circuit 123 generates a drive voltage to be applied to the common electrode (ITO2); and, the gate electrode voltage generator circuit 124 generates a drive voltage (positive bias voltage or negative bias voltage) to be applied to the gate electrodes of thin-film transistors (TFT).

<Arrangement of Drain Driver 130 Shown in FIG. 1>

Figure 4:
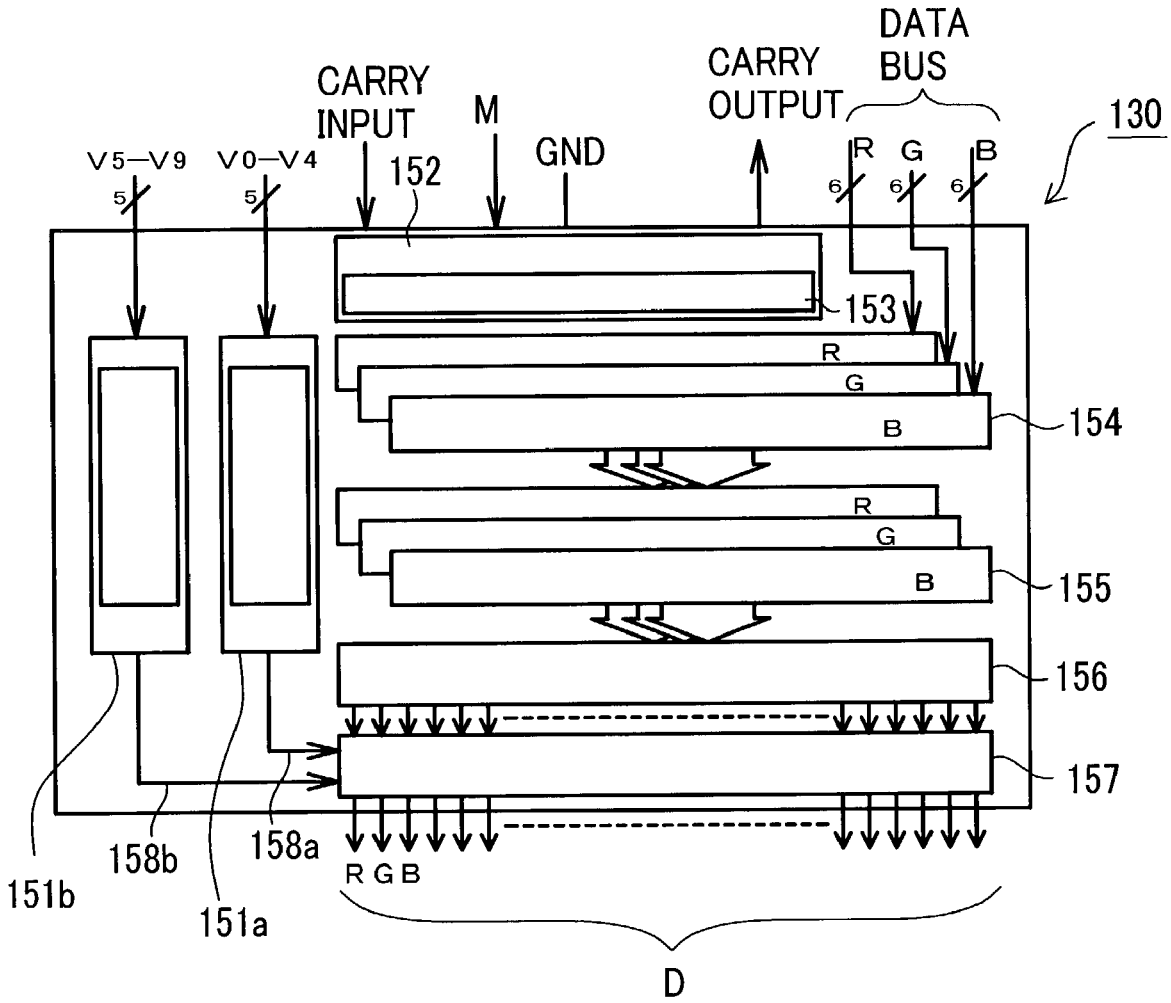
FIG. 4 is a block diagram schematically showing an exemplary configuration of the drain driver shown in FIG. 1.

FIG. 4 is a schematic block diagram showing an exemplary configuration of one of the drain drivers 130 of FIG. 1. Note that the drain driver 130 is formed of a single semiconductor integrated circuit (LSI).

In the circuit of FIG. 4, a positive-polarity gradation voltage generation circuit 151*a* generates a positive gradation voltage with sixty four (64) gradation levels or gradation voltages, based on five-level gradation reference voltages (V0 to V4), which are supplied from the gradation reference voltage generator circuit 121, and this positive gradation voltage is output to an output circuit 157 via a voltage bus line 158*a*.

A negative-polarity gradation voltage generation circuit 151*b* generates a negative gradation voltage with 64 tone levels, based on the five-level gradation reference voltage (V5 to V9), as supplied from the gradation reference voltage generator circuit 121, and the negative gradation voltage is output to the output circuit 157 via a voltage bus line 158*b*.

A shift register circuit 153 within the control circuit 152 of a drain driver 130, based on the clock (CL2) inputted from the display control device 110, generates a data accept-use signal of an input register circuit 154, and then outputs it to the input register circuit 154. The input register circuit 154, based on the data accept signal outputted from the shift register circuit 153, latches a specific number of display data for each color of —6 bits—in synchronism with the clock (CL2) that is inputted from the display control device 110. A storage register circuit 155 latches the display data within the input register circuit 154 in response to the clock (CL1) inputted from the display control device 110. The display data, as taken into this storage register circuit 155, is then inputted to the output circuit 157 via a level shift circuit 156.

The output circuit 157, based on either the 64-level positive gradation voltage or the 64-level negative gradation voltage, selects a single gradation voltage corresponding to the display data (i.e. gradation voltage with one of 64 tone levels) and then outputs it to each drain signal line (D).

<Arrangement of Gradation Reference Voltage Generator Circuit 121 Shown in FIG. 1>

Figure 5:
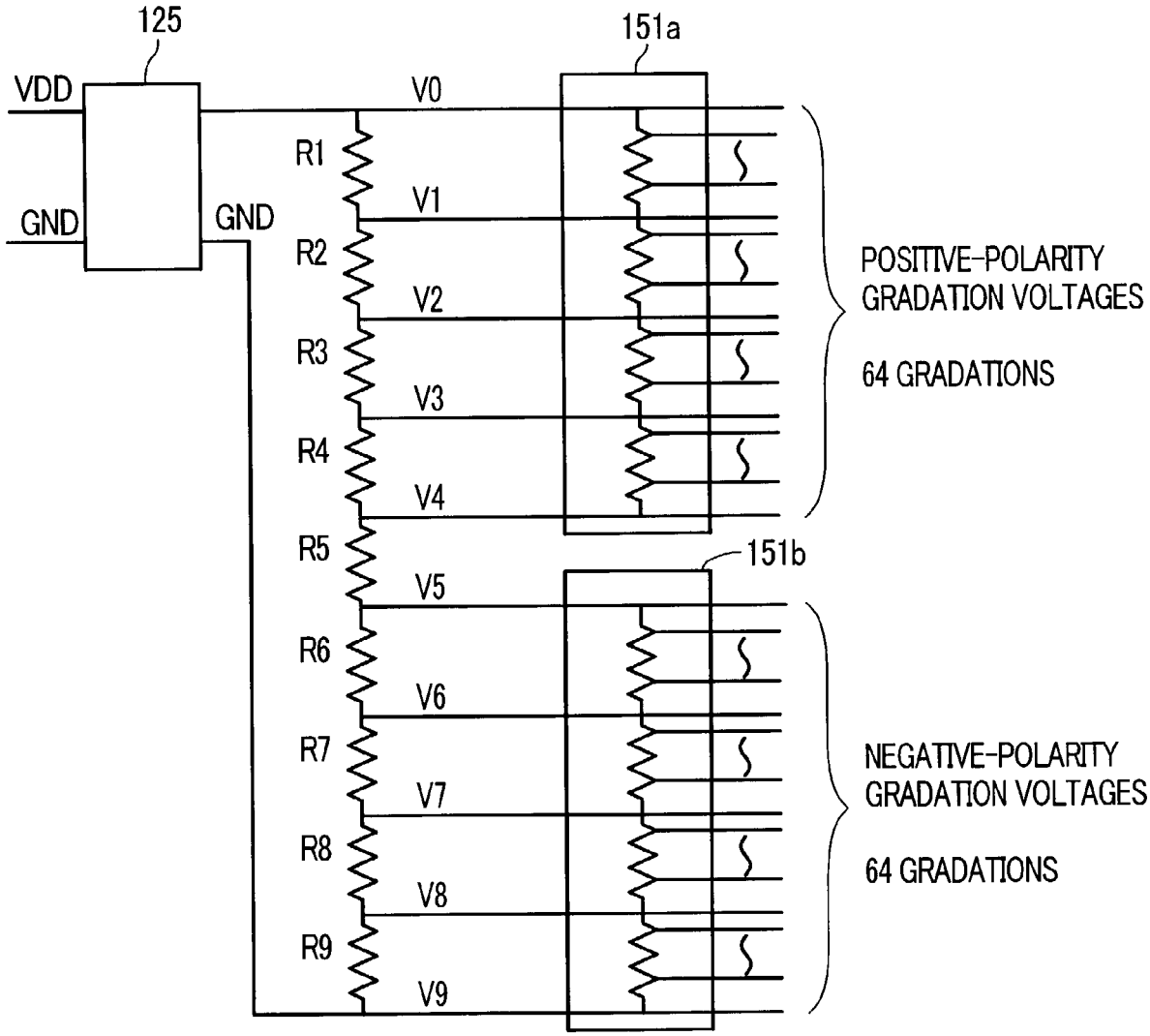
FIG. 5 is a circuit diagram showing a schematic configuration of the gradation reference voltage generation circuit shown in FIG. 1.

FIG. 5 is a circuit diagram schematically showing an example of the configuration of the gradation reference voltage generator circuit 121 of FIG. 1.

As shown in FIG. 5, the gradation reference voltage generator circuit 121 is formed of a resistive voltage divider circuit, which consists essentially of resistors R1 to R9. This resistive voltage divider circuit potentially divides a voltage potentially midway between a voltage V0 outputted from a DC/DC converter 125 and ground potential (GND) to thereby generate gradation reference voltages of V0 to V9.

The five-level gradation reference voltages (V0 to V4), which are outputted from the resistive voltage divider circuit, are inputted to the positive gradation reference voltage generator circuit 151*a* within a drain driver 130. As stated previously, the positive gradation voltage generator circuit 151*a* potentially divides these positive five-level gradation reference voltages (V0 to V4) to thereby generate positive gradation voltages with 64 tone levels.

Similarly, the other five-level gradation reference voltages (V5 to V9) outputted from the resistive voltage divider circuit are inputted to the negative gradation voltage generator circuit 151*b* within a drain driver 130. As described above, this negative gradation voltage generator circuit l5*ib* potentially divides these negative five-value gradation reference voltages (VS to V9) so as to generate negative gradation voltages with 64 tone levels.

<Summary of the Invention>

With the liquid crystal display module in accordance with this embodiment, a two-line inversion method is employed as the driving method thereof.

Figure 6:
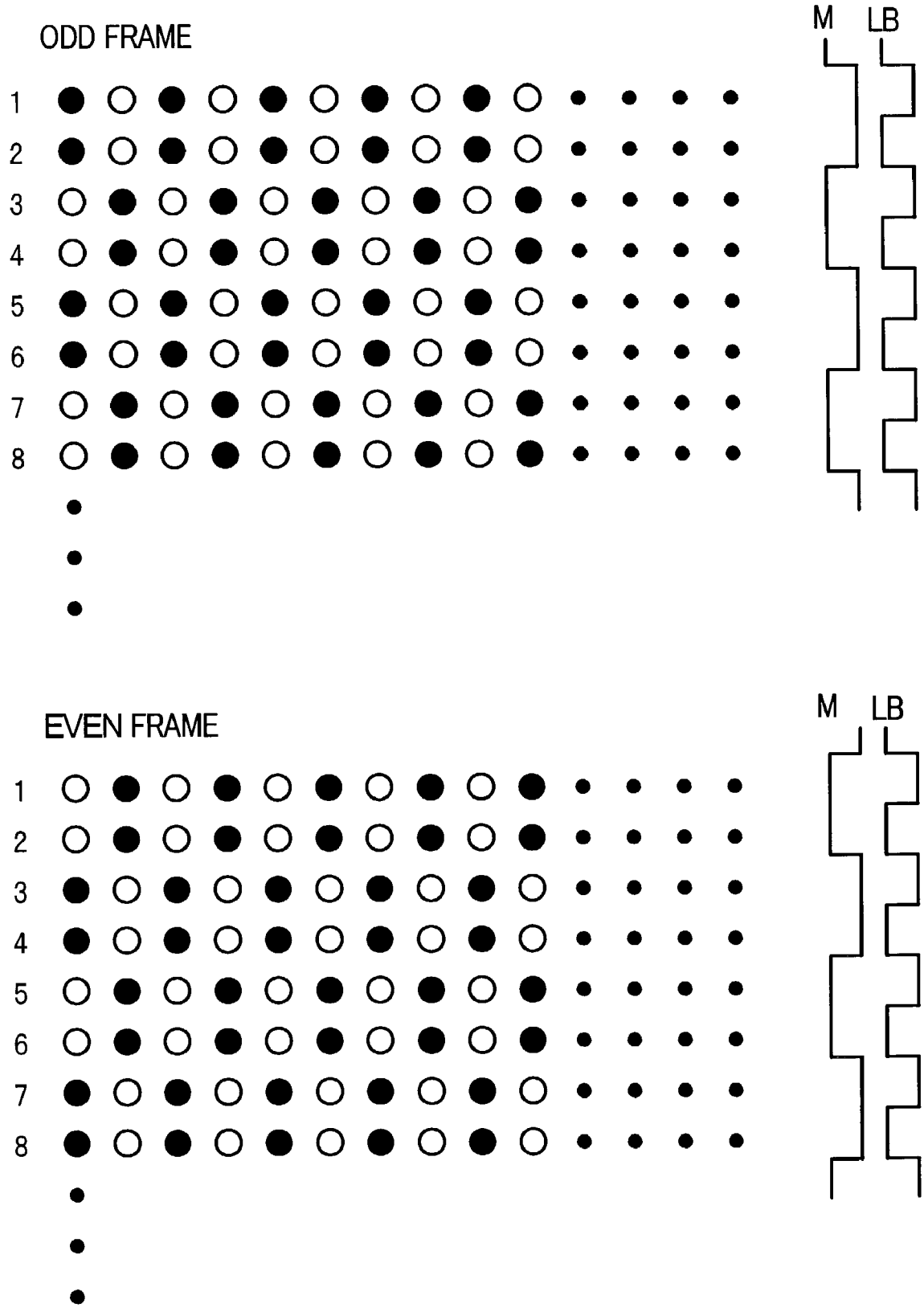
FIG. 6 is a diagram illustrating the polarity of a gradation voltage to be outputted from a drain driver to a drain signal line (D) in case a 2-line inversion method is used as a liquid crystal display module drive method.

FIG. 6 is a diagram showing the polarity of a gradation voltage which is outputted from a drain driver 130 to a drain signal line (D) (i.e. gradation voltage to be applied to the pixel electrode) in the case of using the 2-line inversion method as the liquid crystal display module driving method. Note that in FIG. 6, a positive gradation voltage is indicated by "○", whereas a negative gradation voltage is merely by "•".

Figure 30:
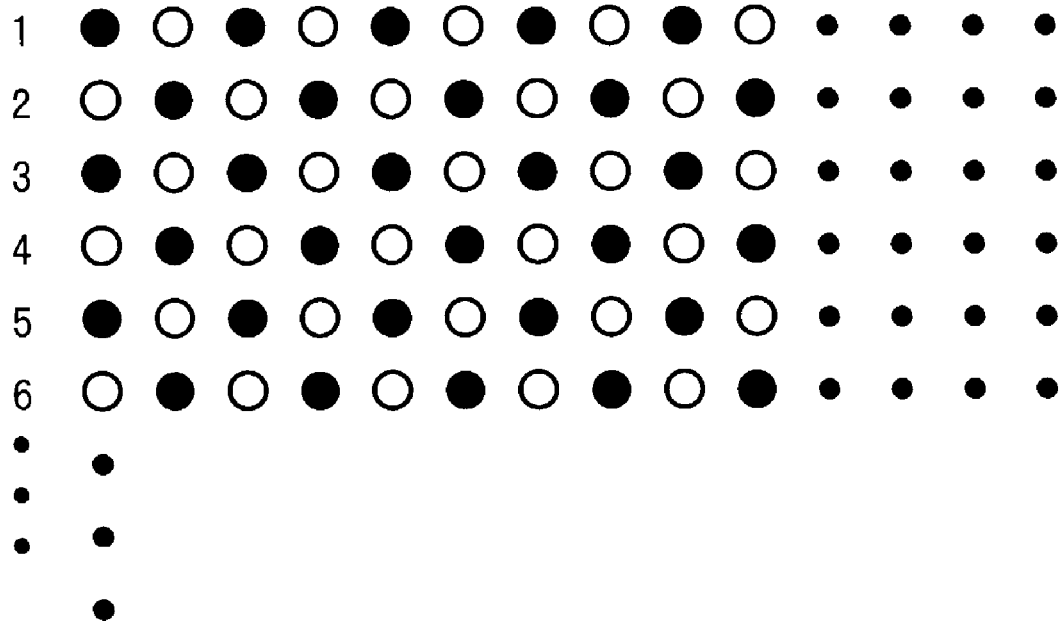
FIG. 30 PRIOR ART
FIG. 30 is a diagram illustrating the polarity of a liquid crystal drive voltage to be outputted from a drain driver to a drain signal line CD) in the case of using a dot-inversion method as the liquid crystal display module drive method.
Figure 30:
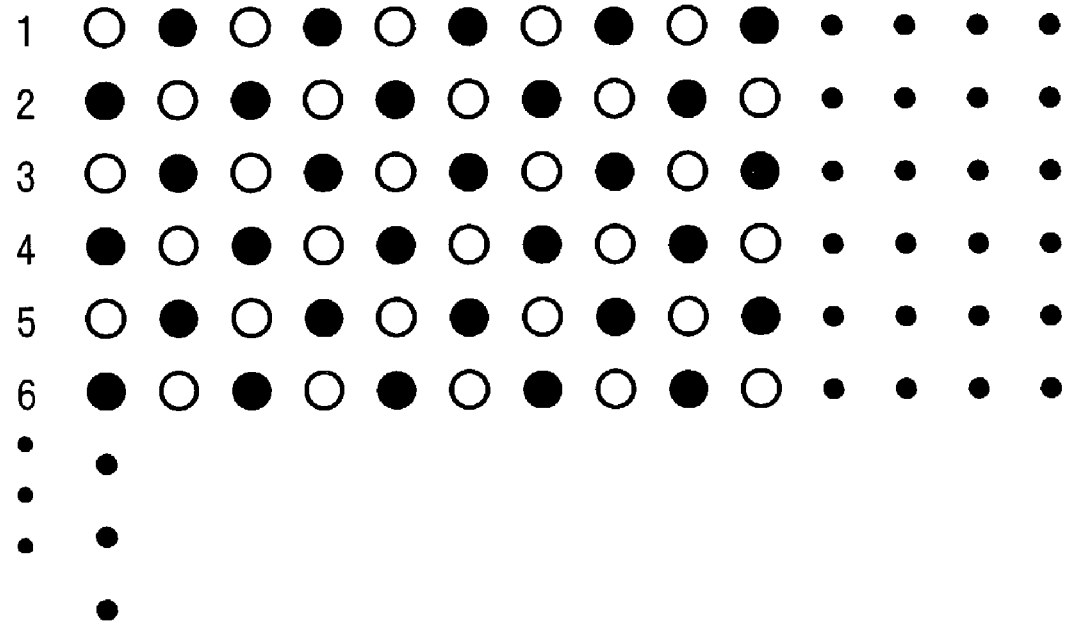
FIG. 30 PRIOR ART
Figure 31:
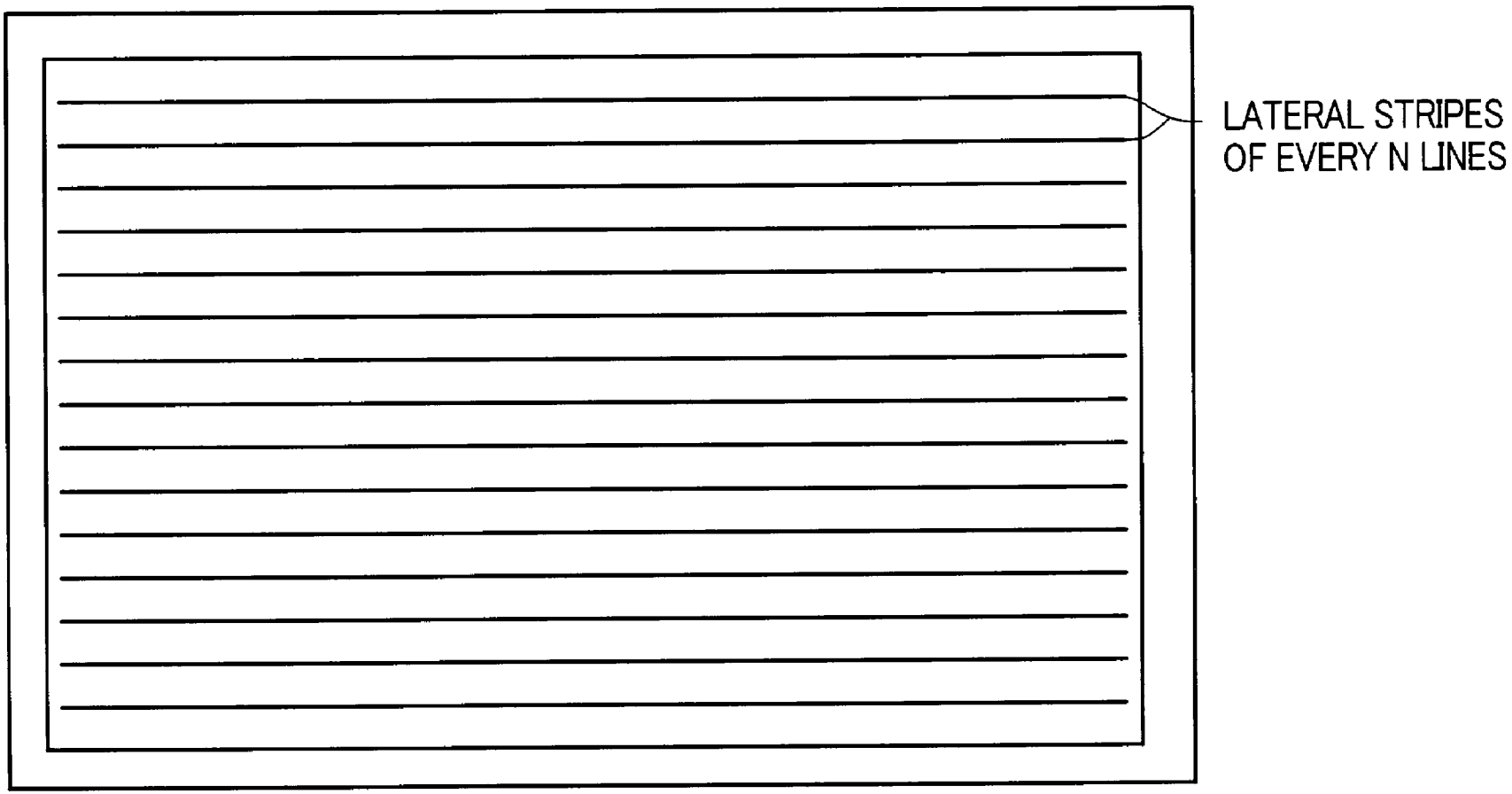
FIG. 31 PRIOR ART
FIG. 31 is a diagram showing a pictorial diagram of a pattern of lateral stripes occurring on the liquid crystal display panel in case an N-line (e.g. 2-line) inversion method is used as the drive method.

The 2-line inversion method is different from the above-noted dot inversion method shown in FIG. 30 merely by the fact that the polarity of a gradation voltage being outputted from a drain driver 130 to a drain signal line (D) is inverted for every two-line group. Thus, any further detailed explanation thereof will be omitted.

For instance, in case a picture image with the same gradation is displayed on the liquid crystal display panel 10, with the 2-line inversion method, the drain driver 130 outputs a polarity-inverted gradation voltage to the drain signal line (D) for every two-line group. An explanation will be given of the reason why the above-described lateral stripes occur in the case of using the 2-line inversion method, with reference to FIG. 7.

Consider the case where the polarity of a gradation voltage that the drain driver 130 outputs to a drain signal line (D) is changed from the negative to the positive polarity. In this case, while the gradation voltage on the drain signal line (D) is negative in polarity prior to inversion of the polarity of such gradation voltage and becomes positive after completion of the polarity inversion, a drain signal line (D) may be regarded as one type of distribution constant line path, so that it is impossible to immediately change from the negative gradation voltage to the positive gradation voltage, resulting in the gradation voltage changing from the negative to the positive polarity with the presence of a certain delay time, as indicated by the drain electrode waveform shown in FIG. 7.

Figure 7:
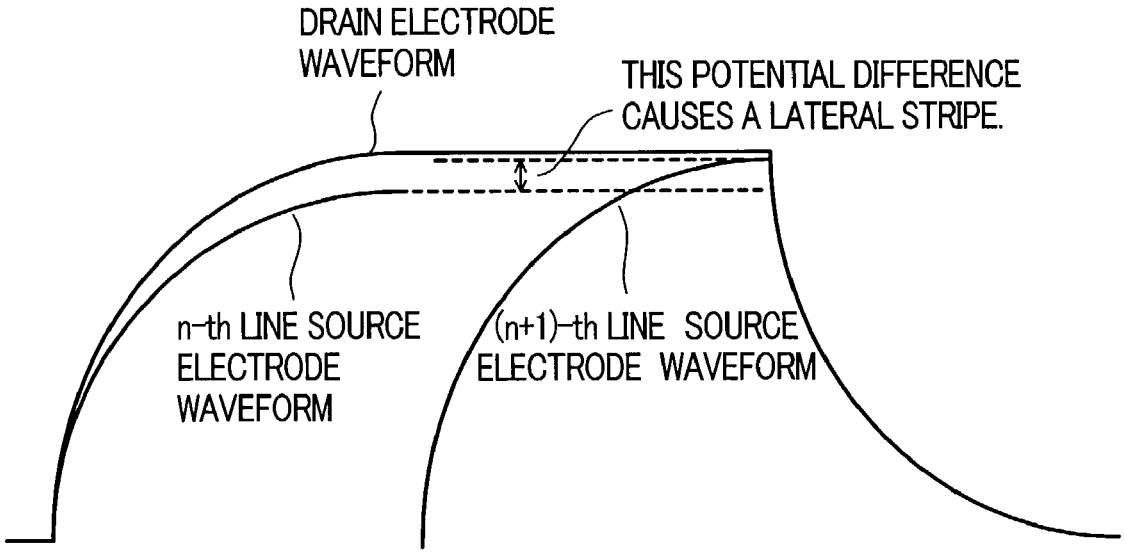
FIG. 7 is a waveform diagram illustrating the reason why lateral stripes take place on the display screen when the 2-line inversion method is used as the liquid crystal display module drive method.

In contrast, at a line which is subsequent to the line immediately after the polarity inversion, the polarity of the gradation voltage being outputted from a drain driver 130 to a drain signal line (D) is kept unchanged, so that the voltage on the drain signal line (D) becomes a predefined gradation voltage. Due to this, as shown in FIG. 7, a source electrode waveform at the (n+1)th line, which is subsequent to the n-th line immediately after the polarity inversion, rises up more rapidly than the source electrode waveform of the n-th line immediately after the polarity inversion. The same is true of the case where the polarity of a gradation voltage to be outputted by the drain driver 130 to the drain signal line D is changed from the positive to the negative polarity.

For the reason described above, a voltage to be written into a pixel on the line immediately after the polarity inversion, as indicated in the source electrode waveform of the n-th line in FIG. 7, and a voltage being written into the pixel on the line subsequent to the line immediately after the polarity inversion, as shown in the (n+1)th line's source electrode waveform in FIG. 7, become different from each other irrespective of the fact that an attempt is made to display the same gradation, resulting in the generation of an on-screen "ghost" pattern with lateral stripes, as described above.

This becomes more visible to the human eye in the case of higher pixel resolutions of the liquid crystal display panel 10, such as 1280×1024 pixels of SXGA display mode and 1600×1200 pixels in UXGA display mode, for example. As apparent from the foregoing, lateral stripes of the type described above are generated due to the presence of a difference between the voltage as written into the pixel(s) on the line immediately after the polarity inversion and the voltage to be outputted that is written into the pixel(s) on the line subsequent to the line immediately after the polarity inversion.

Figure 8:
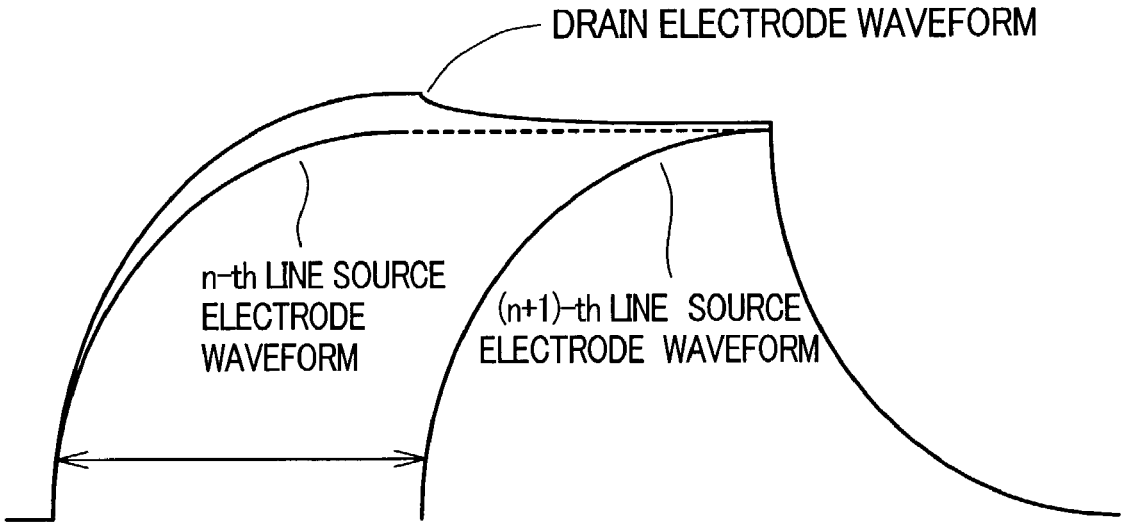
FIG. 8 is a waveform diagram illustrating a summary of a drive method in accordance with Embodiment 1 of the invention.

To avoid this, the present invention employs a specific technique for correcting, at the line immediately after the polarity inversion, the level of a gradation voltage to be outputted from the drain driver 130 to drain signal line (D), as shown in FIG. 8, to thereby equalize the voltage being written into the pixel(s) on the line immediately after the polarity inversion to the voltage being written into the pixel(s) on the line subsequent to the line immediately after the polarity inversion.

In brief, even in the case of displaying the same gradation, in the event of a change from the negative to the positive polarity, as shown by the drain electrode waveform in FIG. 8, at the line immediately after the polarity inversion, correction is performed in such a way that the voltage of a positive gradation voltage being outputted from the drain driver 130 to a drain signal line (D) has a higher potential level from the common voltage (Vcom); while, at the line subsequent to the line immediately after the polarity inversion, a positive gradation voltage of a predetermined tone level is outputted from the drain driver 130 to a drain signal line (D). Alternatively, when a change is from the positive to the negative polarity, correction is performed in such a way that, at the line immediately after the polarity inversion, the voltage of a negative gradation voltage to be outputted from the drain driver 130 to a drain signal line (D) has a lower potential from the common voltage (Vcom); while, at the line subsequent to the line immediately after the polarity inversion, a negative gradation voltage of a predefined tone level is outputted from the drain driver 130 to a drain signal line (D).

With such an arrangement, as shown by the source electrode waveform of the n-th line in FIG. 8 and as shown by the source electrode waveform of the (n+1)th line of FIG. 8, it is possible in accordance with the present invention to cause the voltage being written into the pixel(s) on the line immediately after the polarity inversion to be equal to the voltage as written into the pixel(s) on the line subsequent to the line immediately after the polarity inversion.

In this embodiment, at the line immediately after. the polarity inversion, the gradation reference voltage to be supplied to the drain driver 130 is converted in order to correct or "amend" the voltage of a gradation voltage to be outputted from the drain driver 130 to a drain signal line (D).

<Characteristic Arrangement of Liquid Crystal Display Module of the Embodiment>

Figure 9:
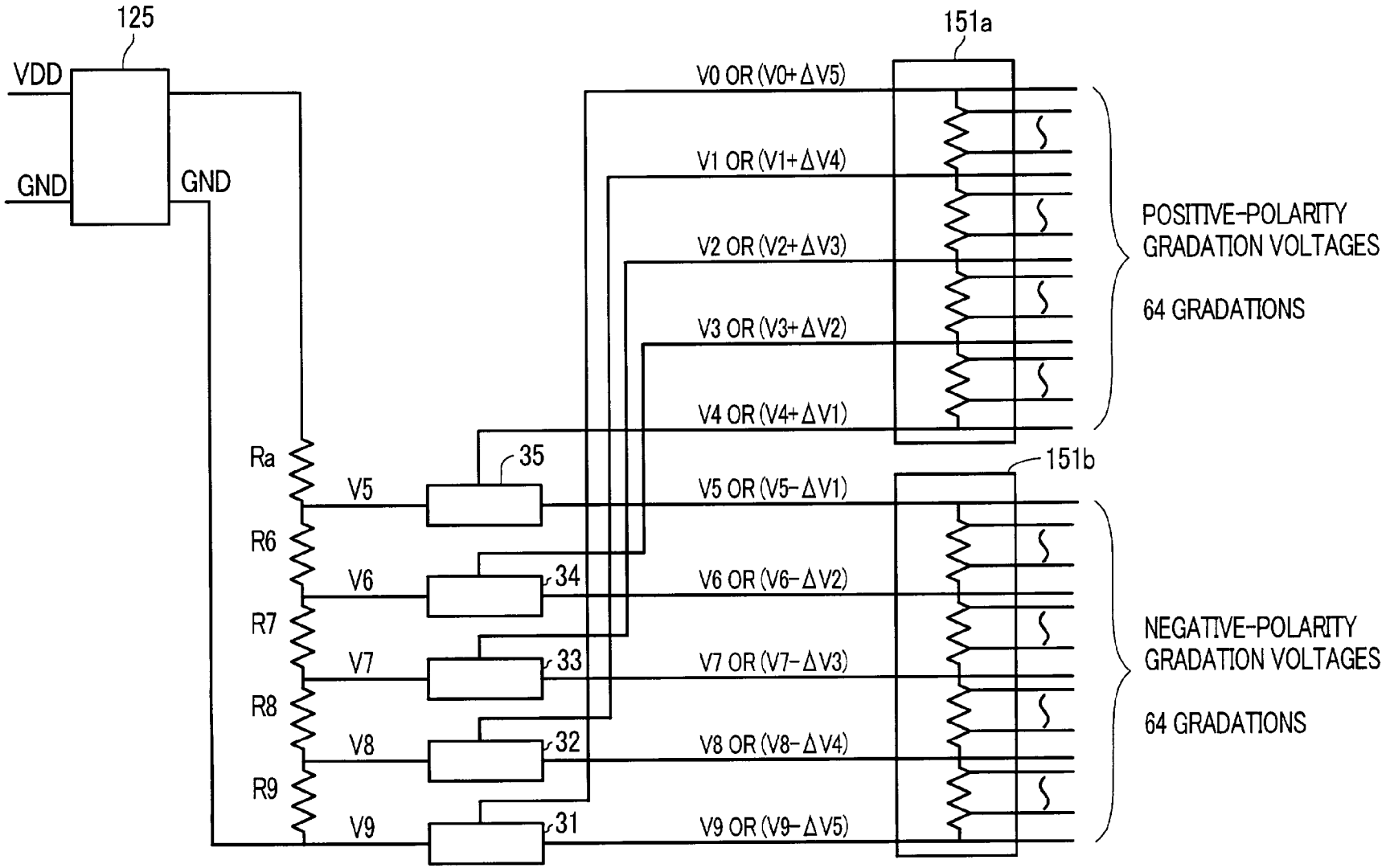
FIG. 9 is a circuit diagram schematically showing a configuration of a gradation reference voltage generator circuit of the liquid crystal display module of Embodiment 1 of the invention.

FIG. 9 is a circuit diagram showing a schematic configuration of the gradation reference voltage generator circuit 121 of the liquid crystal display module of this embodiment.

As shown in FIG. 9, with this embodiment, a resistive voltage divider circuit, consisting essentially of a resistor Ra and resistors R6 to R9, is provided to potentially divide a voltage between the voltage V0 outputted from the DC/DC converter 125 and the ground potential (GND), to thereby generate gradation reference voltages of V5 to V9.

These gradation reference voltages are respectively inputted to correction circuits 31 to 35 in such a way as to supply corrected gradation reference voltages from the correction circuits to the drain drivers 130 when scanning the line immediately after the polarity inversion and to supply in the other case predefined gradation reference voltages from the correction circuits to the drain drivers 130.

Figure 10:
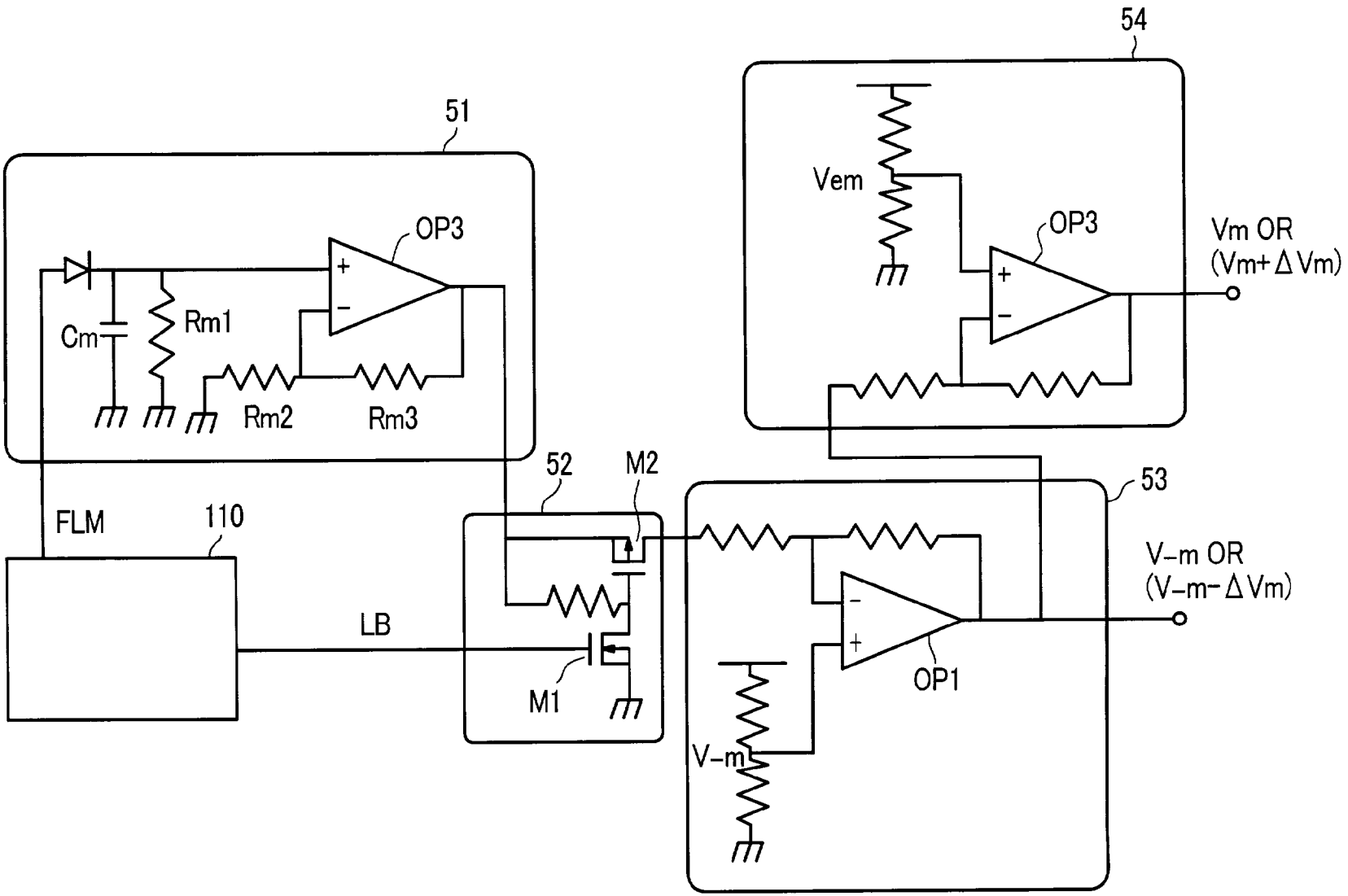
FIG. 10 is a circuit diagram showing a circuit configuration of an example of a correction circuit shown in FIG. 9.

FIG. 10 is a circuit diagram showing an exemplary circuit configuration of one of the correction circuits 31 to 35 shown in FIG. 9. The correction circuit shown in FIG. 10 is formed of a correction voltage generation unit 51, a switch circuit 52, an inversion type amplifier circuit 53, and an inverting amplifier circuit 54.

Figure 11:
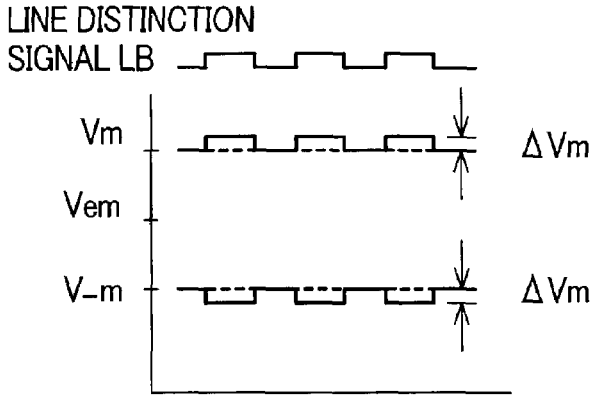
FIG. 11 is a diagram showing voltage levels of output voltages of the correction circuit shown in FIG. 10.

FIG. 11 is a diagram showing voltage levels of output voltages of the correction circuit shown in FIG. 10. An explanation will be given of the operation of the correction circuit shown in FIG. 10, with reference to FIG. 11.

The correction voltage generation unit 51 operates to generate a correction voltage. The arrangement and operation of this correction voltage generation unit 51 will be described later.

The switch circuit 52 is made up of an NMOS transistor (M1) and a PMOS transistor (M2), wherein the MOS transistors (M1, M2) turn off when a correction line discrimination signal (LB) is at Low or "L" level. In this case, an operational amplifier (OP1) of the inverting amplifier circuit 53 constitutes a voltage follower circuit, wherein an output of the op-amp (OP1) becomes a voltage of V-m which is applied to a non-inverting terminal, as shown in FIG. 11. In addition, since this output is inputted to the inverting amplifier circuit 54, an output of the inverting amplifier circuit 54 is such that the voltage of V-m becomes an inverted and amplified voltage Vm with a voltage of Vem that is applied to the non-inverting terminal of an op-amp (OP2) of the inverting amplifier circuit 54 being as a reference, as shown in FIG. 11.

When the correction line discrimination signal (LB) is at High level (referred to just as the H level hereinafter), the MOS transistors (M1, M2) turn on causing a correction voltage (ΔVm), as generated at the correction voltage generator unit 51, to be inputted to the inverting amplifier circuit 53. At this time, as shown in FIG. 11, an output of the inverting amplifier circuit 53 is such that the voltage of Vm becomes an inverted and amplified voltage (V-m−ΔVm), with the voltage of V-rn applied to the non-inverting terminal of the op-amp (OP1) of the inverting amplifier circuit 53 being used as a reference.

Additionally, as shown in FIG. 11, an output of the inverting amplifier circuit 54 at this time is such that the voltage of (V-m−ΔVm) becomes an inverted and amplified voltage (Vm+ΔVm), with the voltage of Vem applied to the non-inverting terminal of the op-amp (OP2) of the inverting amplifier circuit 54 being used as a reference. This voltage is inputted to the positive gradation voltage generator circuit 151*a* and the negative gradation voltage generator circuit 151*b* of the drain driver 130. Thus, when scanning the line immediately after the polarity inversion, a corrected gradation voltage is outputted from the drain driver 130 to drain signal line (D); and, at other times, a predetermined gradation reference voltage is outputted from the drain driver 130 to drain signal line (D), thereby enabling prevention of the generation of a lateral stripe pattern of the type described above.

Next, an explanation will be given of the correction voltage generator unit 51.

The above-stated lateral stripes become greater with an increase in distance from the drain drivers 130. This can be because of the time taken for a drain signal line (D) to change to a predefined gradation voltage immediately after the polarity inversion becomes larger with an increase in distance from the drain drivers 130.

More specifically, while the voltage waveform of the drain signal line (D) can experience waveform-rounding corruption, this waveform corruption increases with an increase in distance from the drain drivers 130, which would result in a difference between the voltage as written into the pixel(s) on the line immediately after the polarity inversion and the voltage being written into the pixel(s) on the line subsequent to the line immediately after the polarity inversion becoming greater with respect to a scan line which is far from the drain drivers 130. Due to this, the correction voltage (ΔVm) to be generated by the correction voltage generator unit 51 is not any potentially constant voltage, but is required to be variable in accordance with the distance between a scan line and the drain driver 130.

Figure 12A:
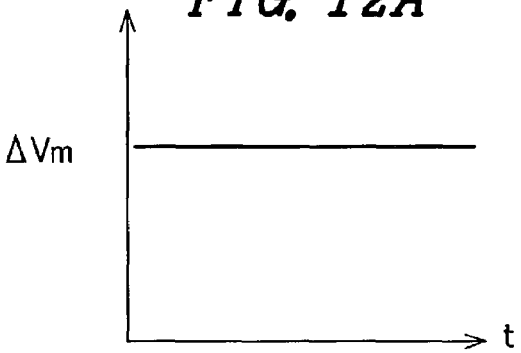
FIGS. 12A to 12E are waveform diagrams showing examples of a correction voltage ($\Delta Vm$) generated at a correction voltage generation unit 51 shown in FIG. 10.

FIGS. 12A to 12E are waveform diagrams showing exemplary voltage waveforms of the correction voltage (ΔVm) as generated by this correction voltage generator unit 51. It is noted that in FIGS. 12A to 12E, the case where the correction voltage (ΔVm) is constant is shown in FIG. 12A for comparison purposes.

Figure 12B:
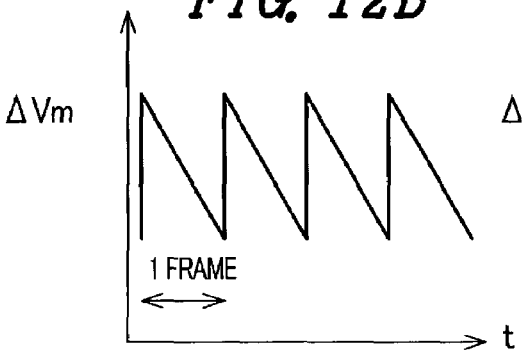
Figure 12D:
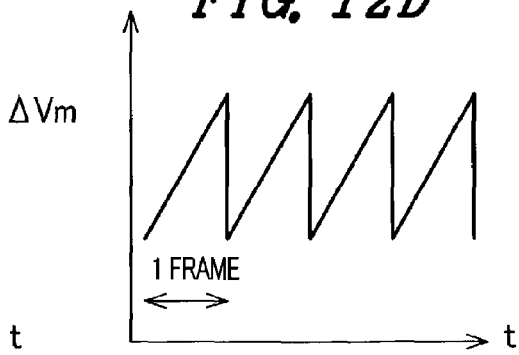
Figure 12C:
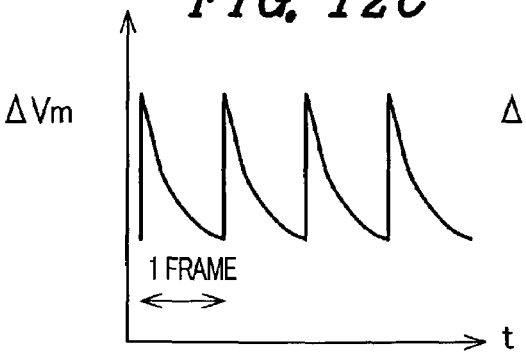
Figure 12E:
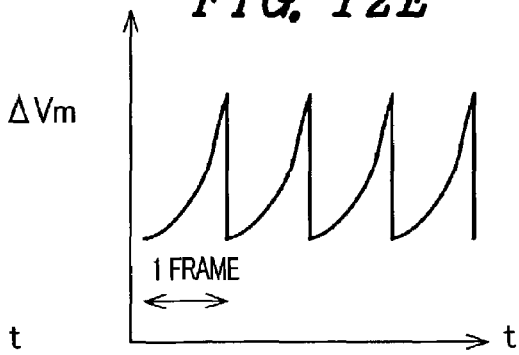

FIGS. 12B and 12C show voltage waveforms of the correction voltage (ΔVm) in case the drain drivers 130 are mounted on the underside of the liquid crystal display panel 10; and FIGS. 12D and 12E show voltage waveforms of the correction voltage (ΔVm) in case the drain drivers 130 are mounted on the upper side of the liquid crystal display panel 10.

Figure 13:
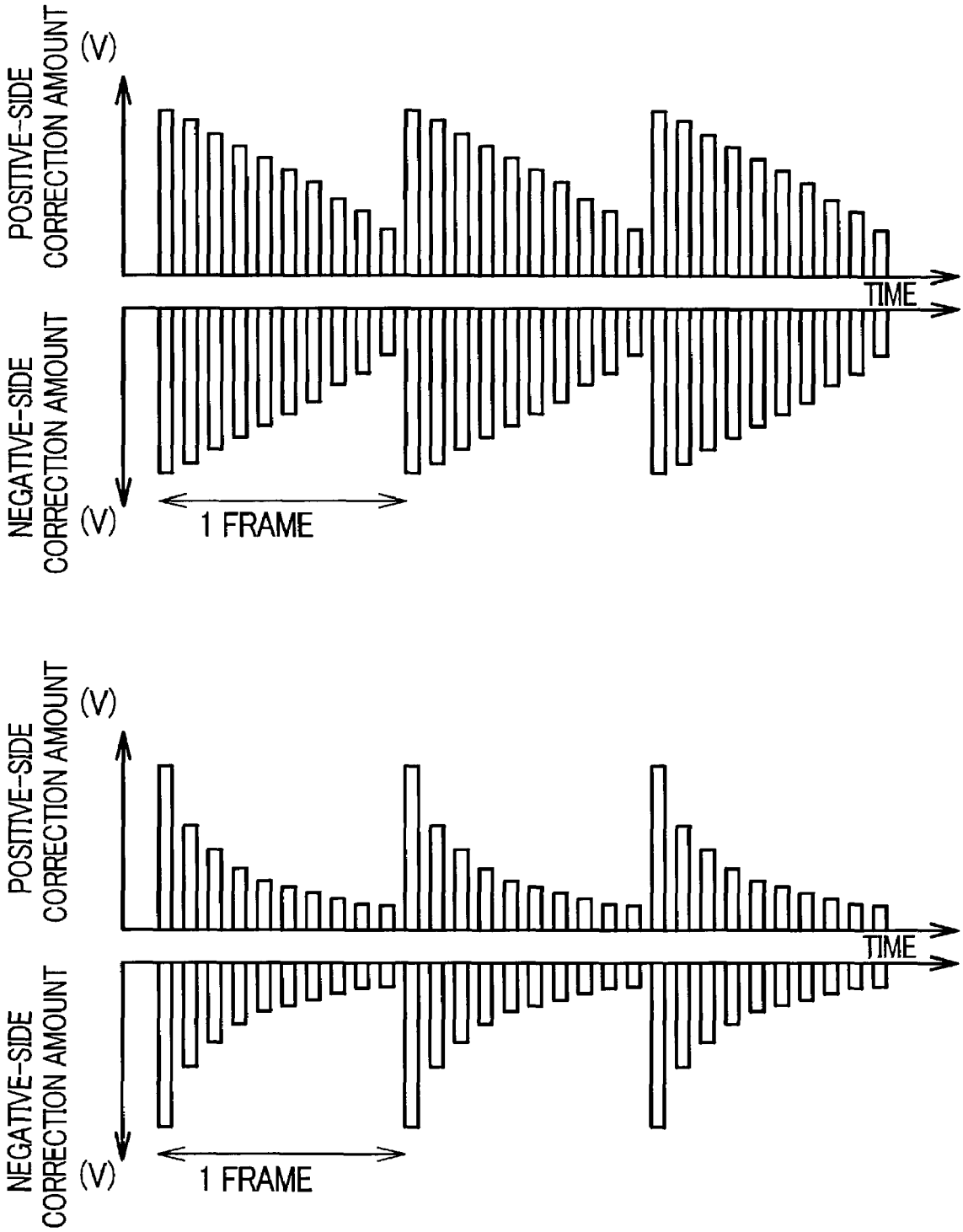
FIG. 13 is a diagram showing waveforms of the correction voltages ($\Delta Vm$) shown in FIGS. 12B and 12C when being inputted to an inversion amplifier circuit through a switch circuit.

An input waveform, upon inputting of the correction voltages (ΔVm) shown in FIGS. 12B and 12C to the inverting amplifier circuit 53 through the switch circuit 52, is shown in FIG. 13. Note here that, in cases where the influence due to a difference in distance from the drain drivers 130, the correction voltage (ΔVm) may be kept constant within one frame period, as shown in FIG. 12A.

In this embodiment, the correction voltage (ΔVm), which is generated by the correction voltage generator unit 51, is generated so as to have a voltage waveform as shown in FIG. 12B. To this end, the illustrative embodiment is arranged to use a method having the steps of charging a capacitive element (Cm) by a pulsate frame start-up instruction signal (FLM) that is outputted in every frame, adjusting the capacitance value of the capacitive element (Cm) and the resistance value of a resistive element (Rm1), adjusting the discharge characteristics of electrical charge charged at the capacitive element (Cm), further adjusting the resistance values of resistive elements (Rm2, Rm3) of the correction voltage generator unit 51, and then adjusting the amplification degree of an op-amp (OP3) configuring the inverting amplifier circuit, thereby adjusting its voltage level.

Here, the capacitance value of the above-noted capacitive element (Cm) and the values of the resistive elements (Rm1, Rm2, Rm3) are adjusted in every gradation reference voltage in such a way that the correction voltage (ΔVm) is different with respect to each of the gradation reference voltages (V5 to V9).

As apparent from the foregoing, in accordance with this embodiment, an arbitrary correction voltage (ΔVm) is given for each gradation reference voltage, thus making it possible to correct each gradation voltage.

Figure 14:
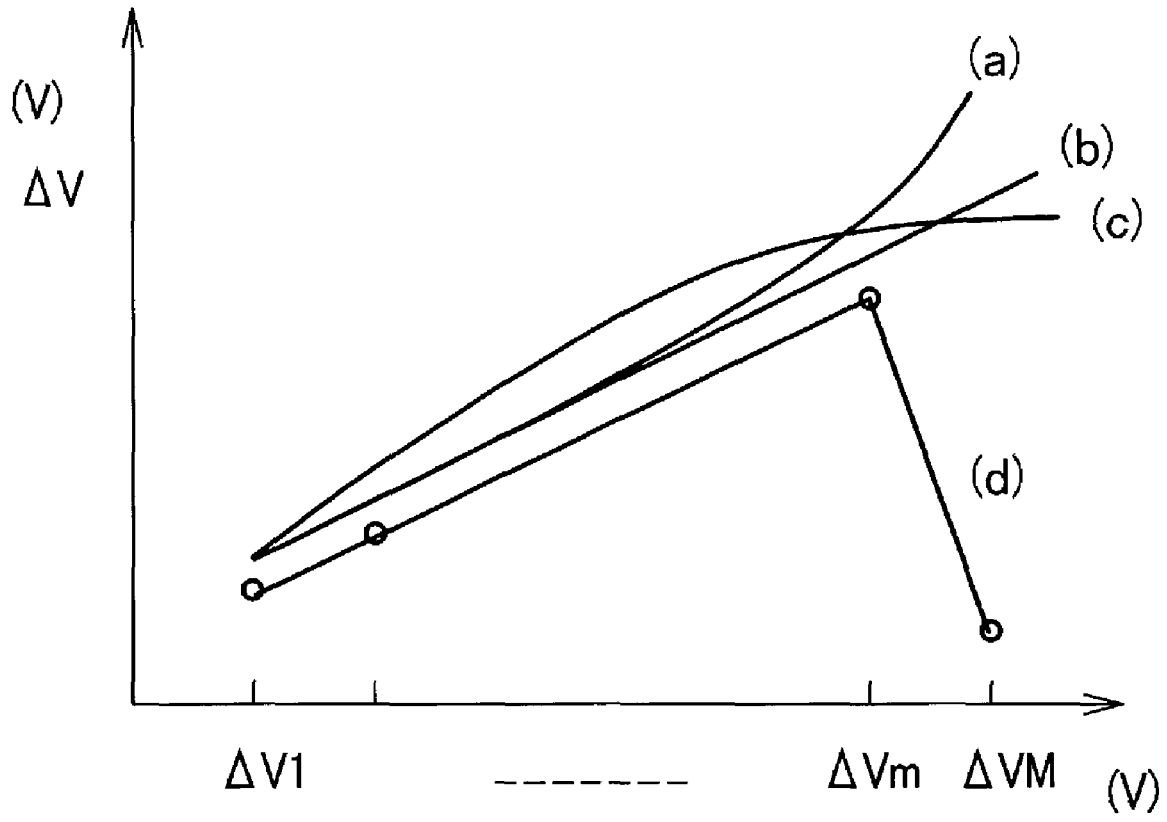
FIG. 14 is a graph showing an example of the correction voltage ($\Delta Vm$) that is given to each gradation voltage with the positive polarity in the embodiment of the invention.

Examples of the voltage amount (ΔV) of a correction voltage, which is given for each gradation reference voltage used to generate each positive gradation voltage, are shown by curves (a), (b), (c) in the graph of FIG. 14. Note that this graph of FIG. 14 shows a case where the gradation reference voltages are from 1 to M.

Embodiment 2

<Characteristic Arrangement of Liquid Crystal Display Module of This Embodiment>

Figure 15:
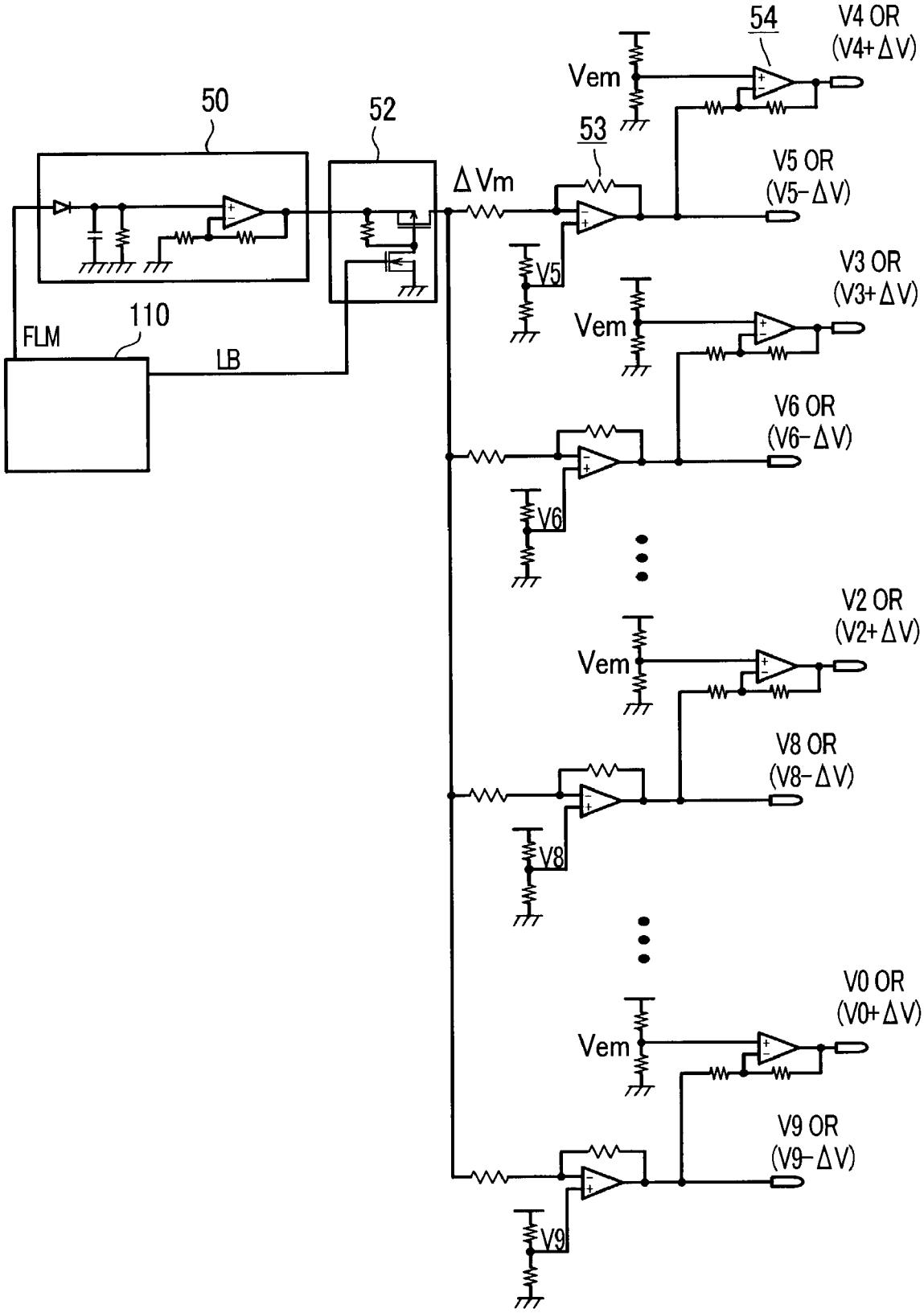
FIG. 15 is a circuit diagram schematically showing a configuration of a gradation reference voltage generation circuit of a liquid crystal display module in accordance with Embodiment 2 of the invention.

FIG. 15 is a circuit diagram showing a schematic configuration of a gradation reference voltage generator circuit 121 of a liquid crystal display module in accordance with the Embodiment 2 of this invention.

As shown in FIG. 15, this embodiment is one that provides a single correction voltage generator unit 50 in place of the correction voltage generator unit 51, which generates a correction voltage (ΔVm) with respect to each of the gradation reference voltages (V5 to V9), wherein a correction voltage (ΔVm) that is generated by this correction voltage generator unit 50, is used as the correction voltage of each of the gradation reference voltages (V5 to V9).

Note that the operation of the gradation reference voltage generator circuit 121 of this embodiment is the same as that of the above-stated Embodiment 1, so that a detailed explanation thereof is omitted herein.

Embodiment 3

<Characteristic Arrangement of Liquid Crystal Display Module of the Embodiment>

Figure 16:
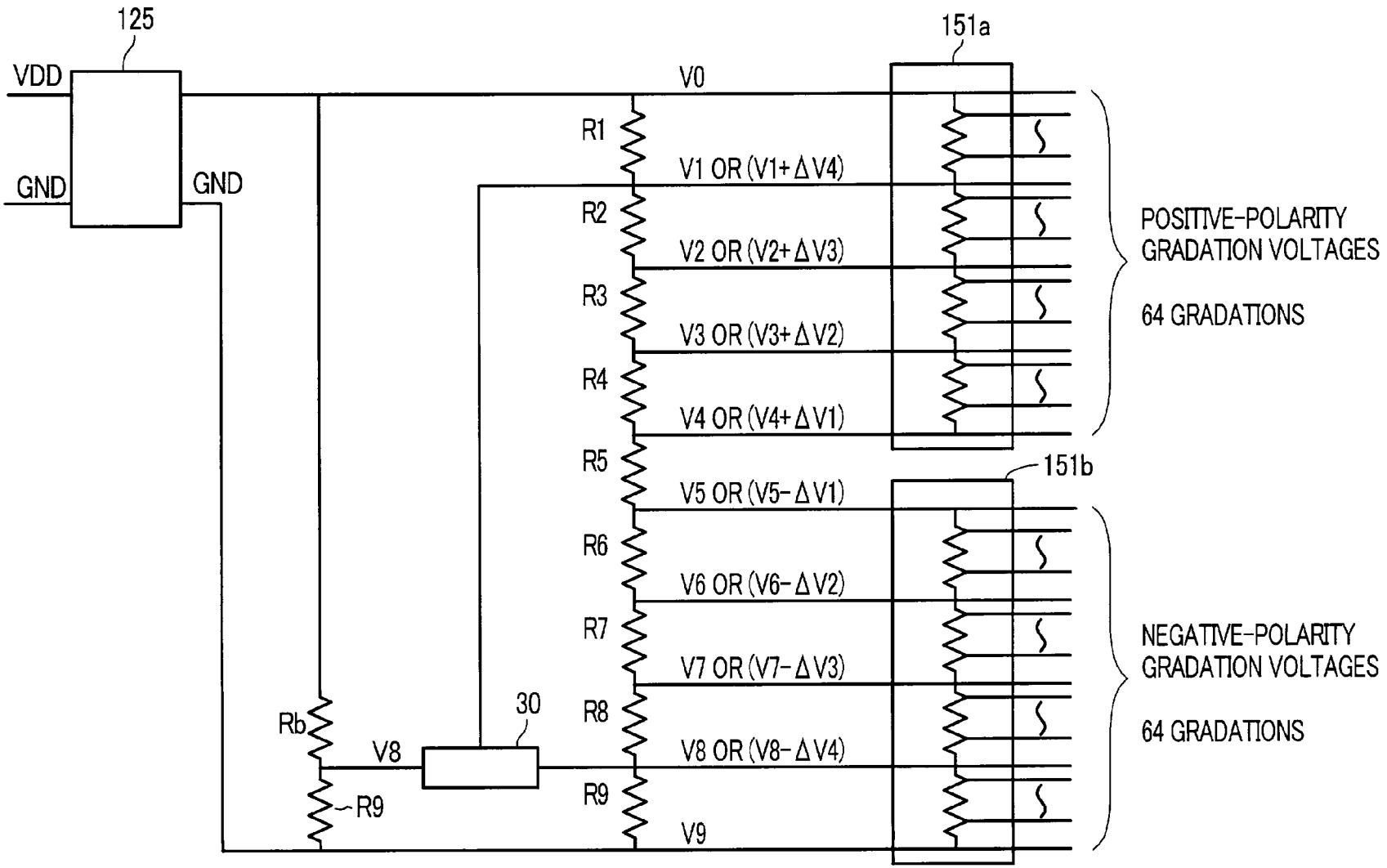
FIG. 16 is a circuit diagram schematically showing a configuration of a gradation reference voltage generator circuit of a liquid crystal display module in accordance with Embodiment 3 of the invention.

FIG. 16 is a circuit diagram showing a schematic configuration of a gradation reference voltage generator circuit 121 of a liquid crystal display module in accordance with Embodiment 3 of this invention.

Although the circuit configurations of the above-mentioned Embodiments 1, 2 are ideal, these require the use of a great number of circuit elements, such as op-amps, resistive elements, capacitive elements and others, resulting in an increase in production cost and an increase in the mounting area. To avoid these risks, this embodiment is one that supplies the correction voltage (ΔVm) only to the gradation reference voltage of Vi and the gradation reference voltage of V8, as shown in FIG. 16.

As shown in FIG. 16, in this embodiment, a resistive voltage divider circuit, consisting essentially of resistors Rb, R9, is provided to potentially divide a voltage between a voltage V0 outputted from DC/DC converter 125 and the ground potential (GND) to thereby generate a gradation reference voltage of V8, which is then input to a correction circuit 30.

Another resistive voltage divider circuit, consisting of resistors R1 to R9, is provided to constitute a gradation reference voltage generation circuit, wherein this resistive voltage divider circuit is used for potentially dividing a voltage between the voltage V0, as outputted from the DC/DC converter 125, and the ground potential (GND), to thereby generate gradation reference voltages of V0 to V9.

And, an output of the correction circuit 30 is connected to a voltage division point or node which outputs the gradation reference voltage of V1 and the gradation reference voltage of V8 of the resistive voltage divider circuit made up of the resistors R1 to R9. The circuit configuration of this correction circuit 30 is the same as that of the correction circuit shown in FIG. 10.

Accordingly, when the line discrimination signal (LB) is at the L level, the gradation reference voltages of V1 and V8, which are outputted from the correction circuit 30, become equal to the gradation reference voltages of V1 and V8 that are generated by the resistive voltage divider circuit made up of the resistors R1 to R9, causing a predetermined gradation reference voltage to be supplied to the drain driver(s) 130. Alternatively, when the line discrimination signal (LB) is at the H level, the corrector circuit 30 outputs a corrected gradation reference voltage of (V1+ΔVm) and a corrected gradation reference voltage of (V8−ΔVm).

Additionally, in view of the fact that the gradation reference voltages of V2 to V7 are generated by voltage division of a voltage between the voltage of (V1+ΔVm) and the voltage of (V8−ΔVm), the gradation reference voltages of V2 to V7 also become corrected gradation reference voltages.

It should be noted that in this embodiment, the voltage value of the correction voltage (ΔVm) becomes maximum at the time of the gradation reference voltages of V1 and V8, become smaller with an increase in difference from the gradation reference voltages of V1 and V8, and become minimum at the time of the gradation reference voltages of V4 and V5. An example of the voltage amount (ΔV) of a correction voltage, which is given with respect to each gradation reference voltage used to generate each positive gradation voltage at this time, is shown by (d) in FIG. 14.

Although the gradation reference voltages of VO and V9 are not corrected here, this causes no specific problems because lateral stripes are not visible to the human eye depending upon the gradation to be displayed by a nearby gradation voltage by way of example.

Also it should be noted that, although in. FIG. 16 the gradation reference voltages of V2 to V7 falling between the gradation reference voltages of V1 and V8 are generated by the resistive voltage divider circuit after completion of correction relative to the gradation reference voltages of V1 and V8, a combination of gradation reference voltages of V2 and V7 may be used in lieu of the gradation reference voltages of V1 and V8, and the gradation reference voltages of V2 and V7 are corrected. Alternatively, a combination of gradation reference voltages of V0 and V9 may be used and corrected. 1n this case, the correction voltages, such as those indicated by (a), (b), (c) in FIG. 14, are obtained.

An explanation will next be given of a method for generating the AC-converted signal (M) and the line discrimination signal (LB) in each of the embodiments described above.

Figure 17:
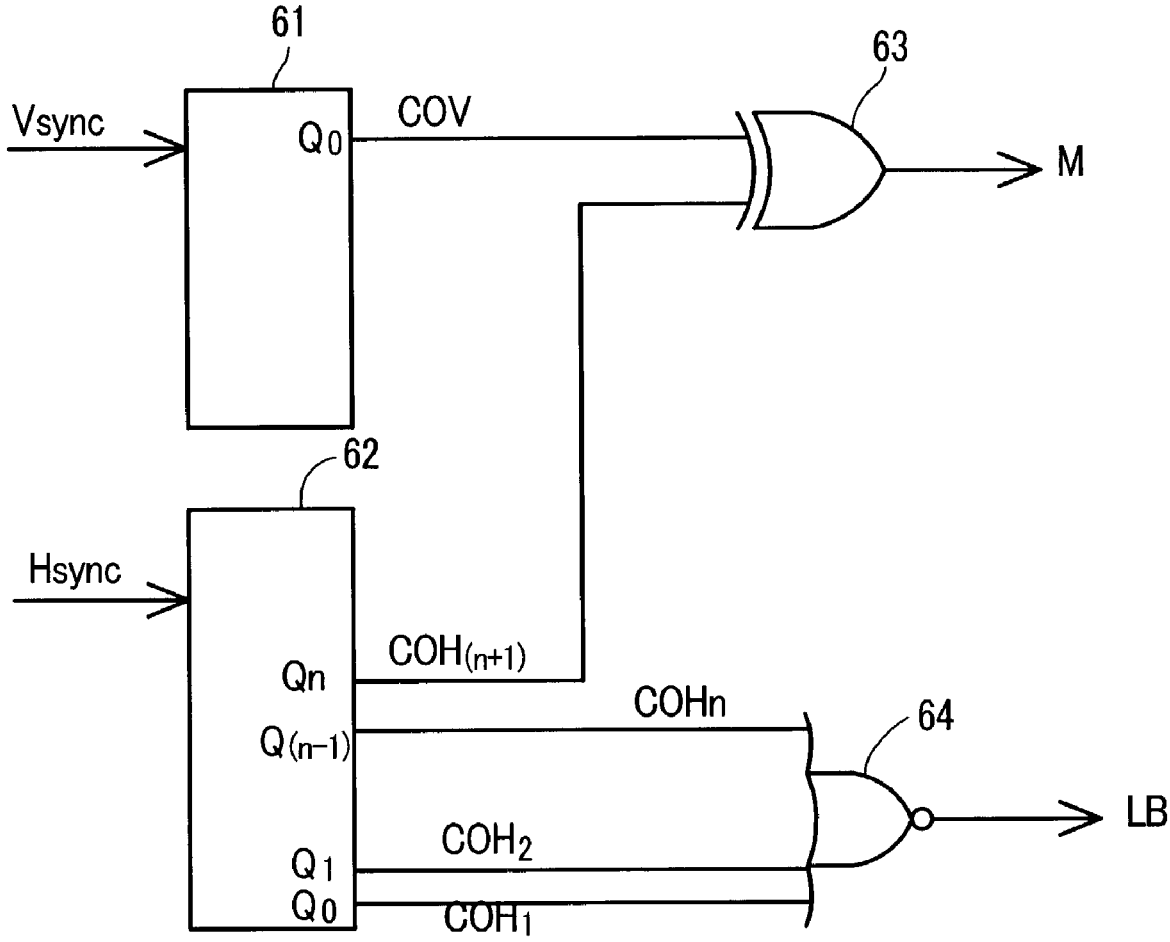
FIG. 17 is a circuit diagram showing a circuit configuration for generation of an AC-converted signal (M) and line discrimination signal (LB) in the liquid crystal display module of each embodiment of the invention.

FIG. 17 is a circuit diagram showing the configuration of a circuit for generating the AC-converted signal (M) and line discriminant signal (LB) in each of the embodiments.

As shown in FIG. 17, a counter 61 is provided for counting pulses of a vertical sync signal (Vsync) and for inputting a $Q_0$ output of a counter 61 to an exclusive-OR (Ex-OR) gate circuit 63. Here, the $Q_0$ output of counter 61 potentially changes alternately between H and L levels at a time whenever the vertical sync signal (Vsync) is inputted. Another counter 62 is provided to count pulses of a horizontal sync signal (Hsync) and to output count signals $Q_0$ to $Q_{n-1}$, which are then input to a NOR gate circuit 64. This NOR gate 64 generates its output signal for use as the line discriminant signal LB. The counter 62 also generates an output signal $Q_n$, which is inputted to the Ex-OR gate 63, which in turn issues an output signal for use as the AC-converted signal m.

Figure 18:
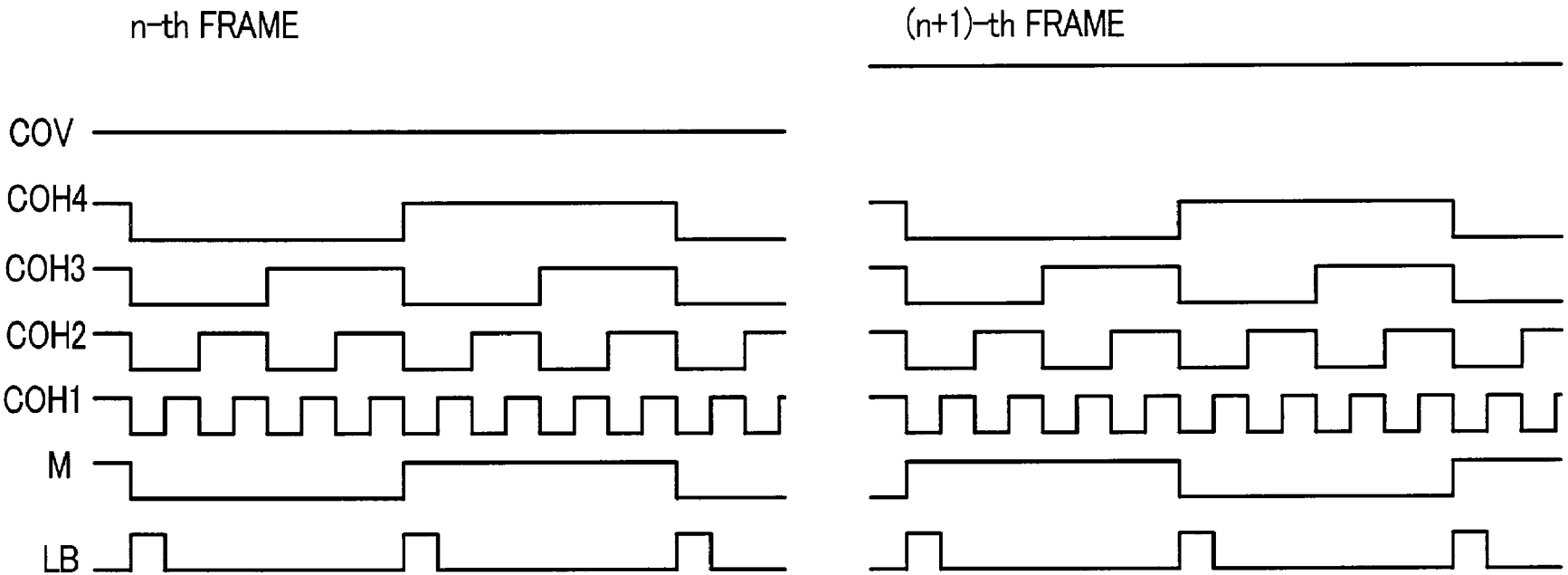
FIG. 18 is a diagram showing a timing chart in the case of a 8 (n=3) line inversion method in the circuit shown in FIG. 17.

A timing chart of the circuit of FIG. 17 in the case of 8 (n=3) line inversion method is shown in FIG. 18. In FIG. 18, "COV" designates the $Q_0$ output of the counter 61, whereas COH1 to COH4 denote the $Q_0$ to $Q_n$ outputs of the counter 62.

Figure 19:
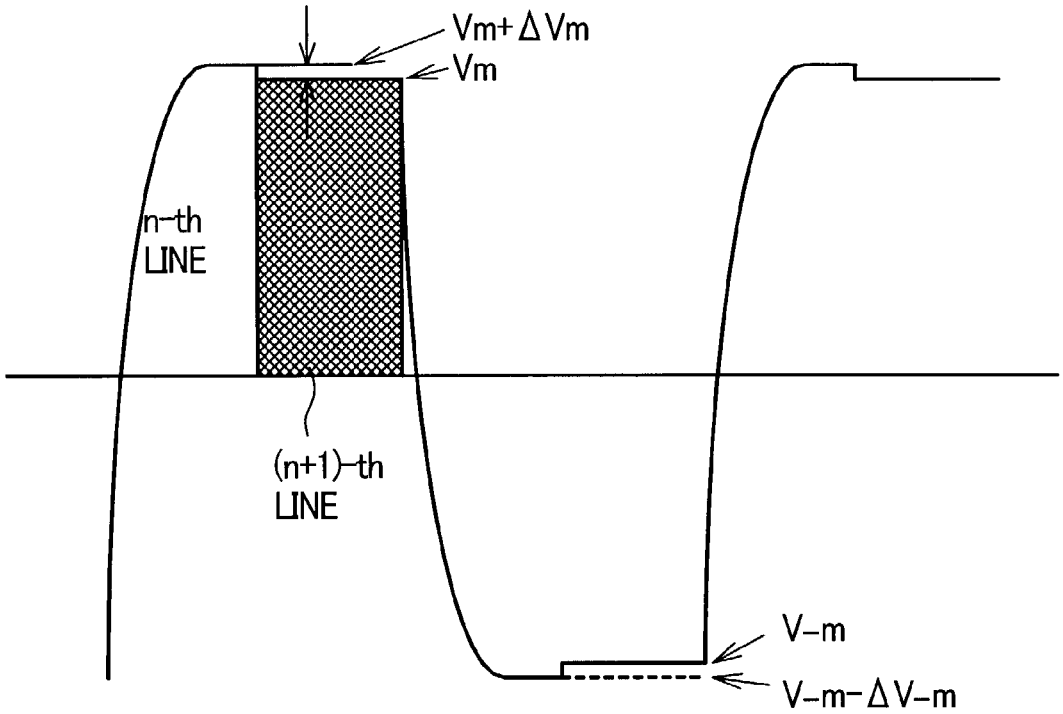
FIG. 19 is a waveform diagram illustrating the case for correction of a gradation voltage being outputted from a drain driver to a pixel(s) on n-th line in the liquid crystal display module of the Embodiment 1 of the invention.
Figure 20:
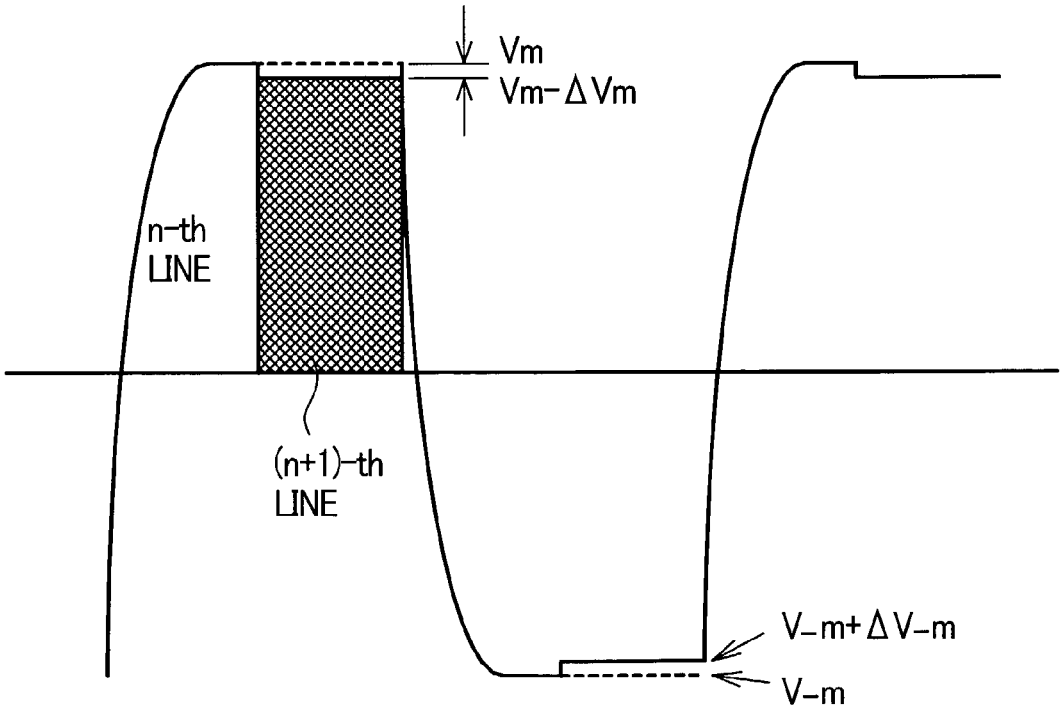
FIG. 20 is a waveform diagram illustrating the case for correction of a gradation voltage to be outputted from the drain driver to a pixel(s) on an (n+1)-th line in the liquid crystal display module of the Embodiment 1 of the invention.

Although, in each of the above-stated embodiments, the gradation voltage to be outputted from a drain driver 130 to a pixel(s) on the n-th line is corrected in such a way that the voltage as written into the pixel on the n-th line immediately after polarity inversion, and the voltage being written into a pixel(s) on the (n+i)th line subsequent to the n-th line immediately after the polarity inversion become equal to each other, as shown in FIG. 19, the gradation voltage being outputted from the drain driver 130 to the pixel on the (n+i)th line may be corrected, so that the voltage as written into the pixel on the n-th line immediately after the polarity inversion becomes equal to the voltage being written into the pixel on the (n+i)th line subsequent to the n-th line, immediately after the polarity inversion as shown in FIG. 20.

Figure 21:
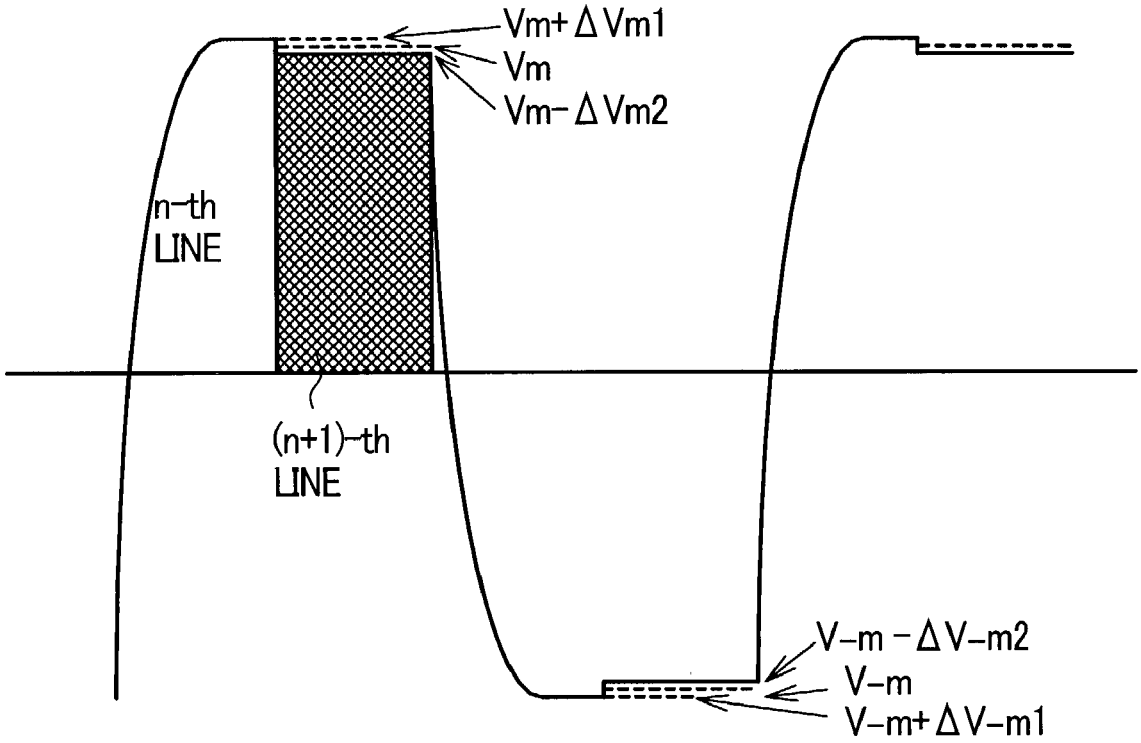
FIG. 21 is a waveform diagram illustrating the case for correction of a gradation voltage to be outputted from the drain driver to the pixels on the n-th line and (n+1)-th line in the liquid crystal display module of the Embodiment 1 of the invention.

Alternatively, as shown in FIG. 21, the gradation voltages, which are outputted from the drain driver 130 to the pixels of the n-th line and (n+i)th line, may be corrected in such a way that the voltage as written into the pixel on the n-th line immediately after the polarity inversion becomes equal to the voltage being written into the pixel on the (n−i−1)th line subsequent to the n-th line immediately after the polarity inversion.

Figure 22:
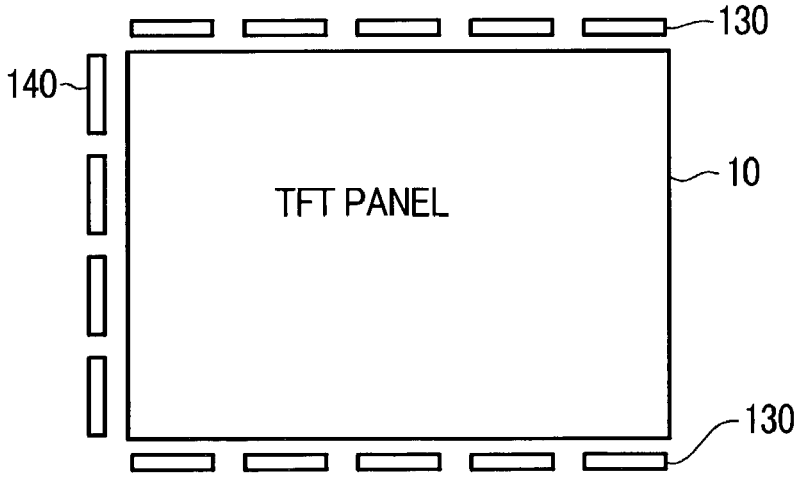
FIG. 22 is a diagram showing a liquid crystal display panel with drain drivers mounted along both long sides thereof.
Figure 23A:
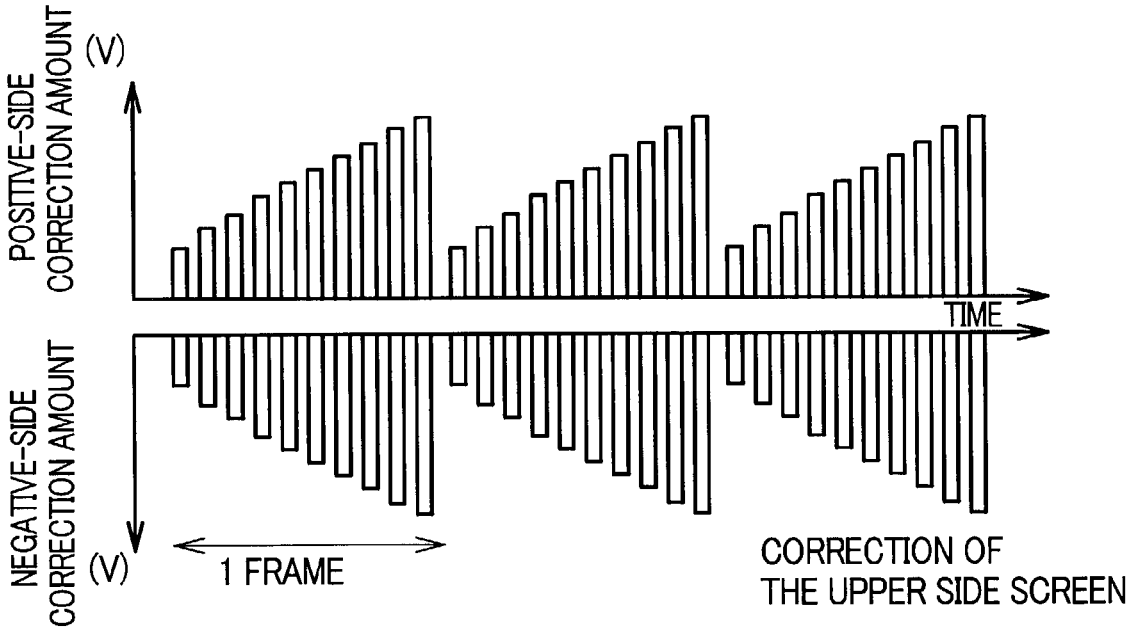
FIGS. 23A and 23B are diagrams each showing the waveform of a correction voltage (ΔVm) in the case of the liquid crystal display panel shown in FIG. 22.
Figure 23B:
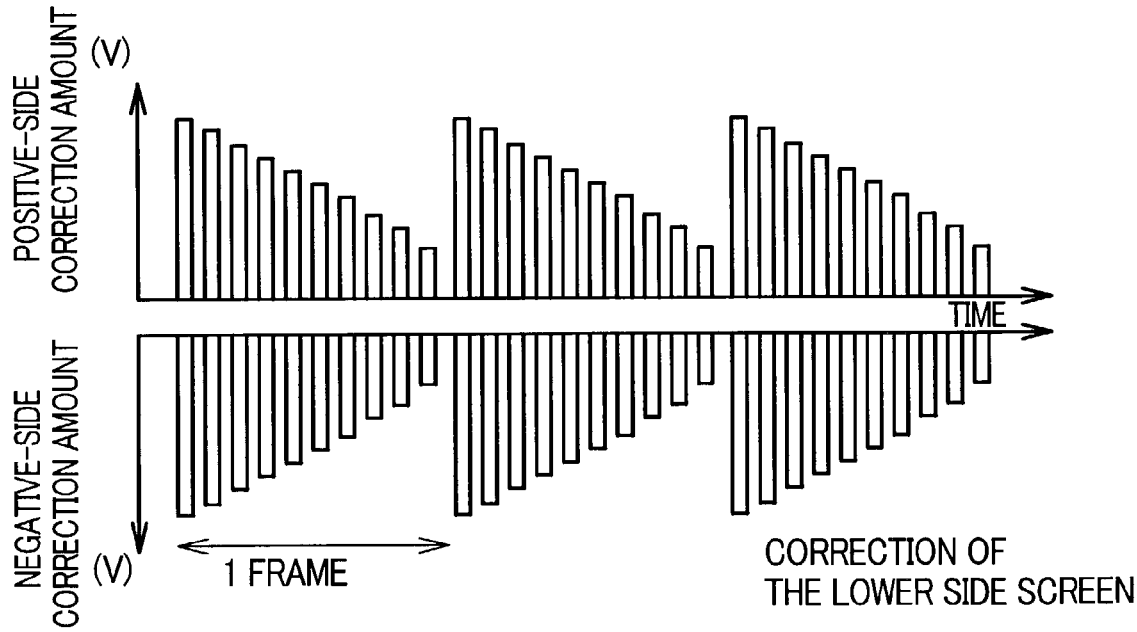

Note that, in FIGS. 19 to 21, examples are provided of inverting and driving for every two lines in a group. Also note that, although in each of the above embodiments an explanation is made relative to the case where the drain drivers 130 are mounted along one of the long sides of the liquid crystal display panel 10, in case the drain drivers 130 are mounted along both of the long sides of the liquid crystal display panel 10, as shown in FIG. 22, for example, it should be required, as shown in FIGS. 23 and 23B, to prepare two types of waveforms as the voltage waveform of a correction voltage (ΔVm) for use on a per-frame basis, one of which is for use as a gradation voltage (waveform shown in FIG. 23A) to be outputted from drain drivers 130 on the upper side of the liquid crystal display panel 10 and the other of which is for use as a gradation voltage (waveform shown in FIG. 23B) being outputted from the other drain drivers 130 on the lower side of liquid crystal display panel 10.

In this way, according to each of the embodiments described above, in case a multiple-line inversion method is employed as the driving method thereof, it becomes possible to prevent the occurrence of lateral stripes on the display screen of the liquid crystal display panel 10, thereby making it possible to improve the display quality of the display screen to be displayed on the liquid crystal display panel 10.

Embodiment 4

<Characteristic Arrangement of Liquid Crystal Display Module of the Embodiment>

In each of the embodiments, the gradation voltage to be outputted from a drain driver 130 to a pixel on the n-th line is corrected to cause the voltage written into the pixel on the n-th line immediately after the polarity inversion and the voltage being written into the pixel on the (n+1)th line subsequent to the n-th line immediately after the polarity inversion to become equal to each other.

Figure 24:
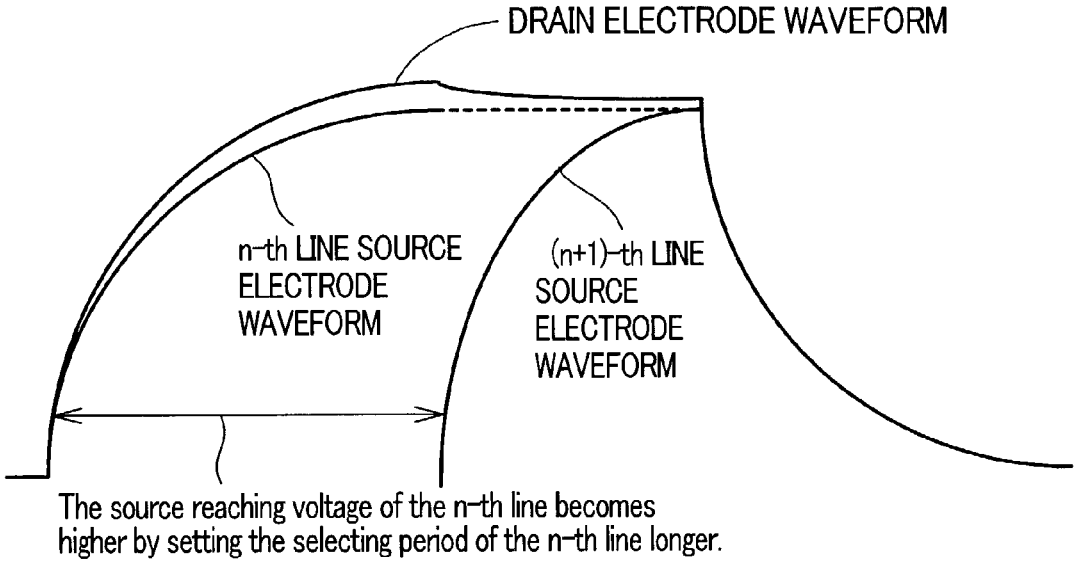
FIG. 24 is a waveform diagram illustrating a summary of a drive method in accordance with Embodiment 4 of the invention.

This embodiment is one that is arranged as shown in FIG. 24 to allow the length of a horizontal scan period (i.e. scan time or select time) of the n-th line immediately after the polarity inversion to be greater than the length of a horizontal scan period of the (n+1)th line subsequent to the n-th line immediately after the polarity inversion, in addition to the drive method of each of the embodiments described above.

Generally, even at gate signal lines (G), waveform rounding corruption occurs in select signals outputted from gate drivers 140 in a similar way to the drain signal lines (D), resulting in a decrease in the length of the turn-on period of the thin-film transistors (TFT1, TFT2) at locations that are distant from the gate drivers 140. That is, the greater the distance from the gate drivers 140, the shorter the TFT turn-on period. As a result, lateral stripes occurring on the display screen of the liquid crystal display panel 10 also become visible to the human eye more appreciably at pixels farther from the gate drivers 140.

For prevention of such on-screen lateral stripes, it is effective to lengthen the scan time of the n-th line immediately after the polarity inversion, so that it is longer than the scan time of the (n+i)th line subsequent to the n-th line immediately after the polarity inversion.

Figure 25:
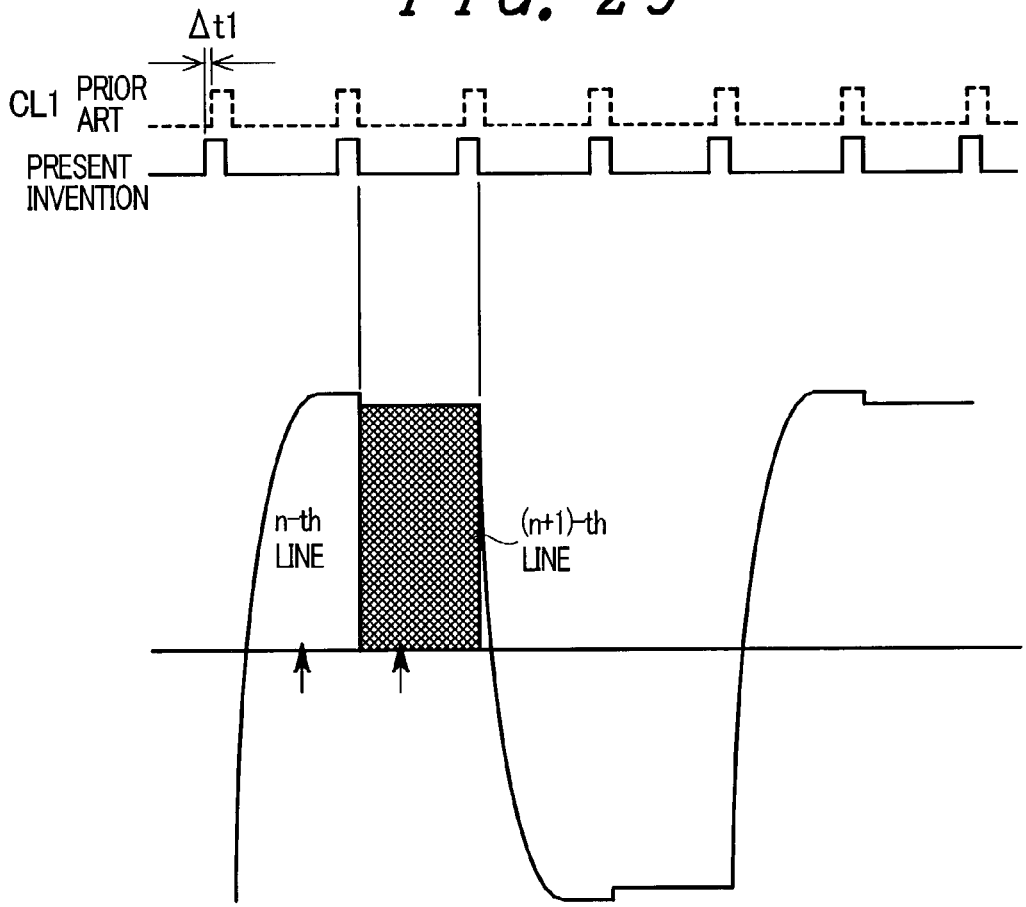
FIG. 25 is a waveform diagram illustrating an exemplary method for lengthening one horizontal scan time period of the n-th line immediately after polarity conversion in the liquid crystal display module of the Embodiment 4 of the invention.
Figure 26:
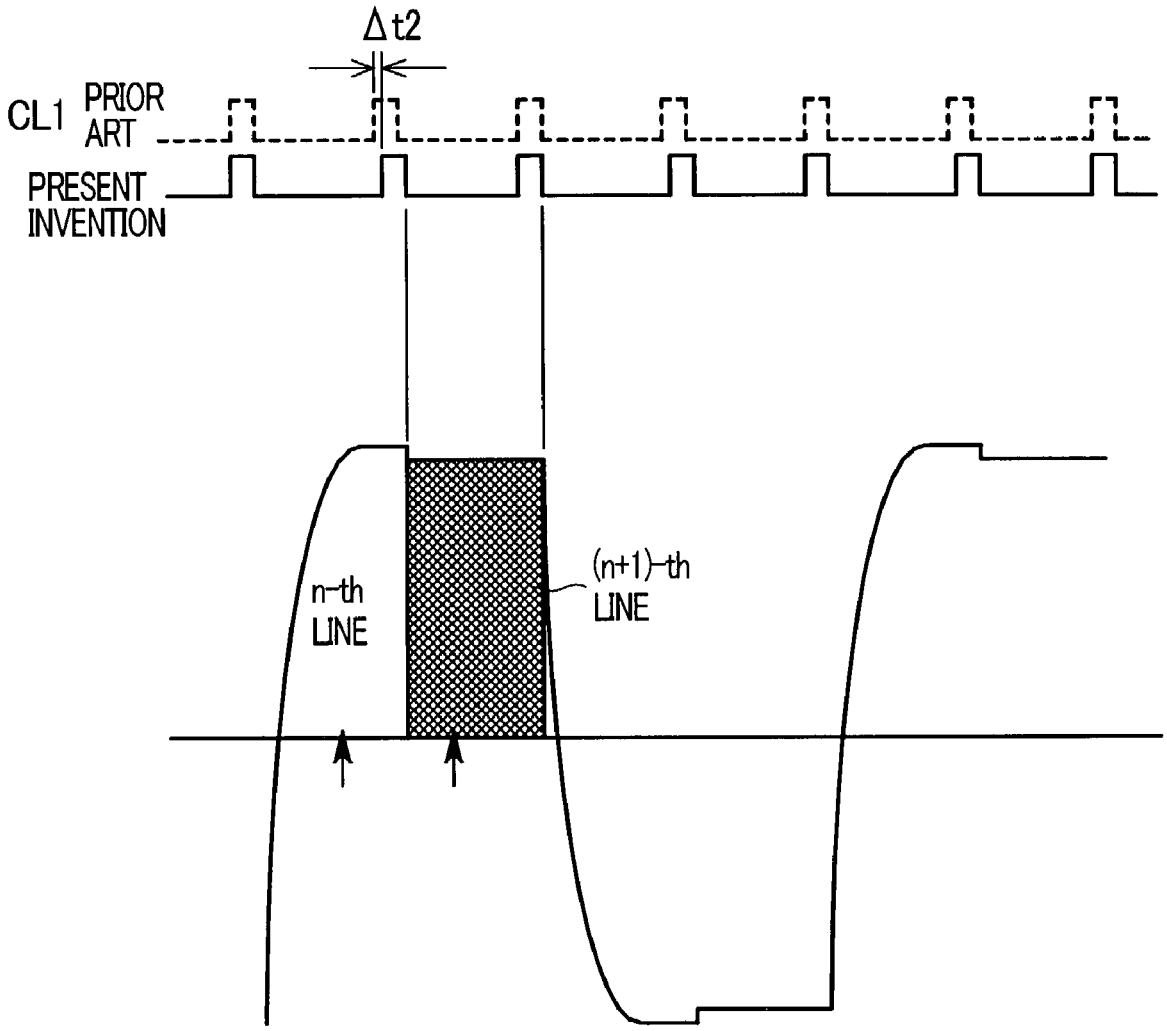
FIG. 26 is a waveform diagram illustrating another exemplary method for lengthening one horizontal scan time period of the n-th line immediately after the polarity conversion in the liquid crystal display module of the Embodiment 4 of the invention.
Figure 27:
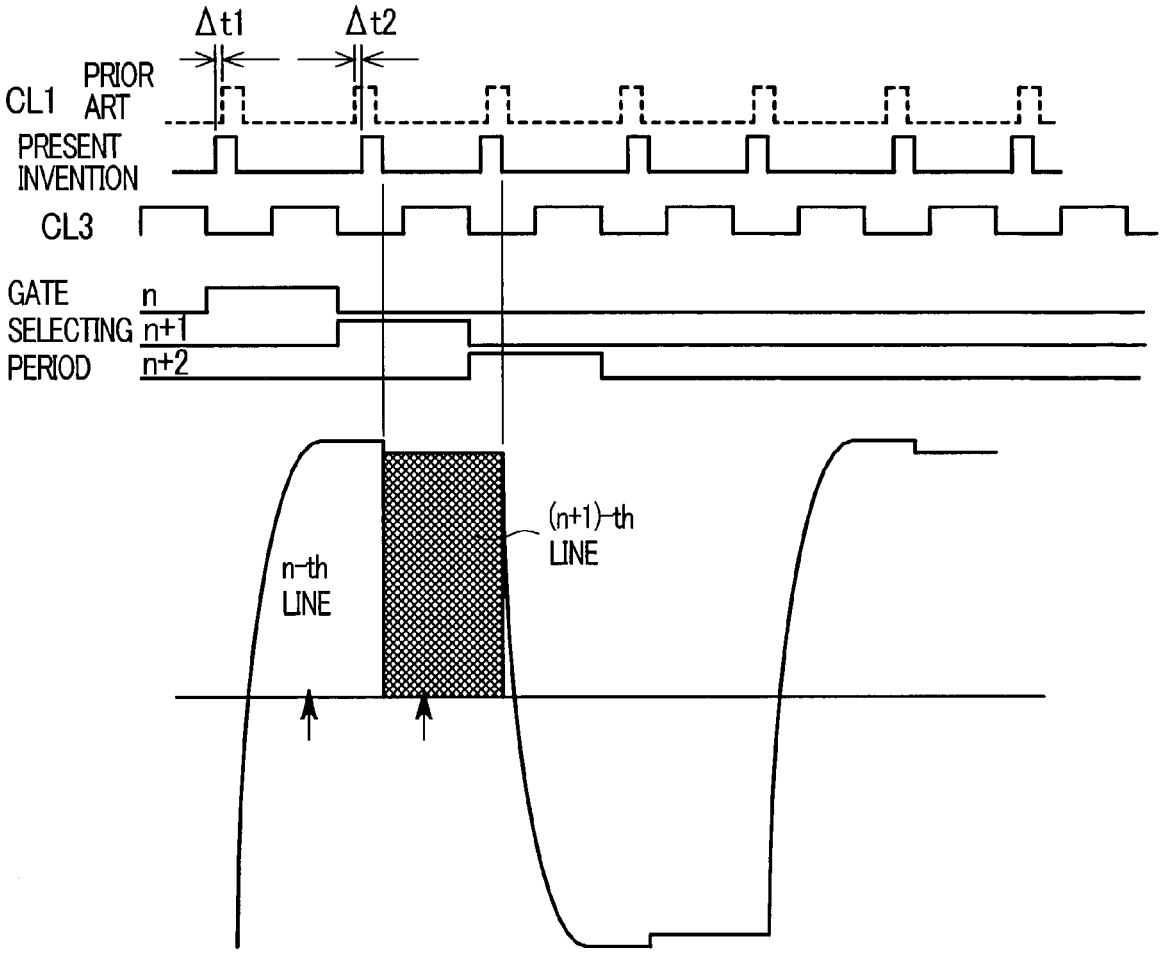
FIG. 27 is a waveform diagram illustrating a further exemplary method for lengthening one horizontal scan time period of the n-th line immediately after the polarity conversion in the liquid crystal display module of the Embodiment 4 of the invention.

In this embodiment, the methodology for lengthening one horizontal scan period of the above-stated n-th line immediately after the polarity inversion includes, but is not limited to: a method in which the generation timing of the clock (CL1) at the n-th line immediately after the polarity inversion, is made to be earlier than in the prior art, as shown in FIG. 25; a method in which the generation timing of the clock (CL1) at the (n+1)th line, subsequent to the n-th line, immediately after the polarity inversion, is made to be later than in the prior art, as shown in FIG. 26; or a method in which the generation timing of the clock (CL1) at the n-th line immediately after the polarity inversion, is made to be earlier than in the prior art, while at the same time making the generation timing of the clock (CL1) at the (n+i)th line subsequent to the n-th line immediately after the polarity inversion later is made to be than in the prior art, as shown in FIG. 27.

Note that arrows are shown in FIGS. 25 to 27 to indicate the timings of the outputs from the drain drivers 130.

Figure 28A:
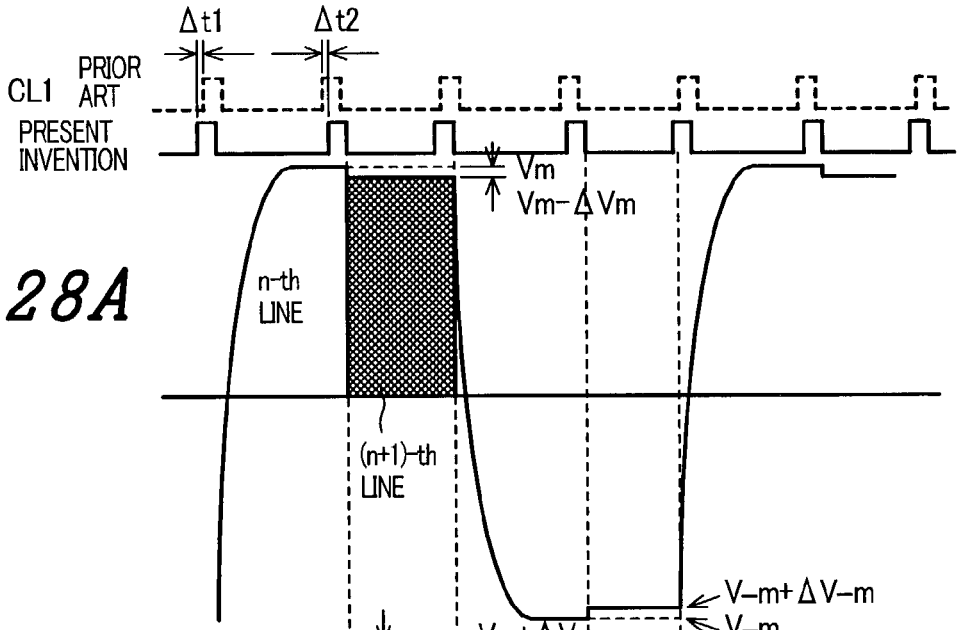
FIGS. 28A to 28C are waveform diagrams, each of which illustrates the case of a combined use of the method for lengthening one horizontal scan time period of n-th line immediately after the polarity conversion and a method for correcting a gradation voltage to be outputted from a drain driver in the liquid crystal display module of Embodiment 4 of the invention.
Figure 28B:
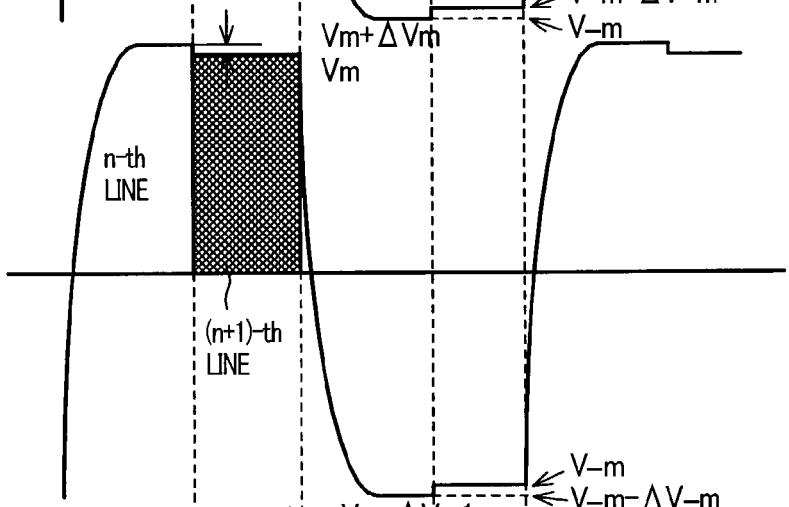
Figure 28C:
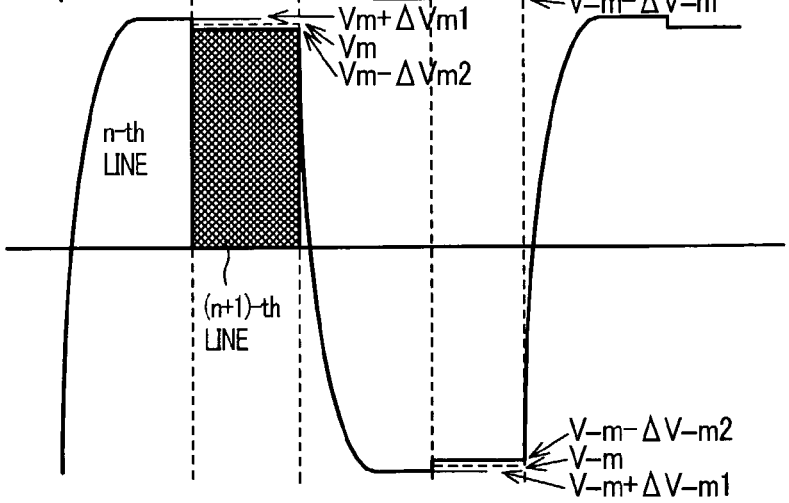

FIGS. 28A to 28C show the case of combining together the method for making the generation timing of the clock (CL1) at the n-th line immediately after the polarity conversion earlier than in the prior art, while simultaneously making the generation timing of the clock (CL1) at the (n+i)th line subsequent to the n-th line immediately after the polarity inversion later than in the prior art, in order to equalize the voltage to be written into the pixel on the n-th line immediately after the polarity inversion and the voltage being written into the pixel on the (n+1)th line subsequent to the n-th line immediately after the polarity inversion and the above-stated method shown in FIG. 19 for correcting the gradation voltage to be outputted from the drain driver 130 to the pixel on the n-th line (FIG. 28B), and the case for combination with the method shown in FIG. 20 for correcting the gradation voltage being outputted from the drain driver 130 to the pixel on the (n+i)th line (FIG. 28A), and also the case for combination with the method shown in FIG. 21 for correcting the gradation voltage outputted from a drain driver 130 to the pixels on the n-th line and (n+i)th line (FIG. 28C).

An explanation will be given of a method for adjusting the generation timing of the clock (CL1) in this embodiment.

Figure 29:
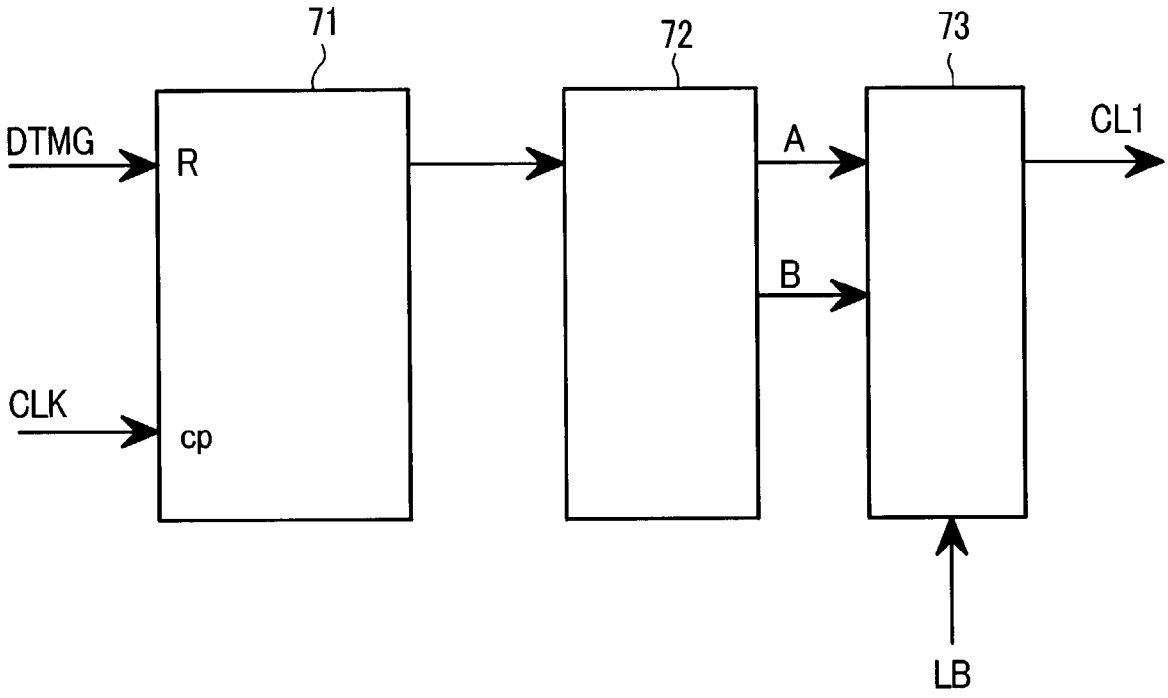
FIG. 29 is a block diagram showing a configuration of a circuit which adjusts a clock (CL1) generation timing in the liquid crystal display module of the Embodiment 4 of the invention.

FIG. 29 is a circuit diagram showing the configuration of circuitry which adjusts the generation timing of the clock (CL1). In FIG. 29, a counter 71 is reset by a display timing signal (DTMG) and counts the number of clocks (CLK) from a time point at which the display timing signal (DTMG) becomes at the H level. While the count number of this counter 71 is inputted to a decoder 72, the decoder 72 outputs a pulse signal at its output terminal "A" when the count number is equal to a first counter number and outputs a pulse signal at an output terminal "B" when the count number is equal to a second counter number.

The pulse outputted from the output terminal A of the decoder 72 or from the output terminal B thereof is selected by a multiplexer 73, which is controlled by a correction line discrimination signal (LB), thus becoming the clock (CL1).

In this way, with this embodiment, in addition to the method of each of the embodiments stated previously, the length of the horizontal scan period of the n-th line immediately after the polarity inversion is made longer than the length of the horizontal scan period of the (n+1)th line subsequent to the n-th line immediately after the polarity inversion; thus, in the case of employing a multiple-line inversion method as the drive method, it becomes possible to preclude occurrence of lateral stripes on the entire area of the display screen of the liquid crystal display panel 10, thus enabling further improvement in display quality of the display screen to be displayed on the liquid crystal display panel 10.

It must be noted that JP-A-9-15560 discloses a method for making the horizontal scan period of a line immediately after polarity inversion longer than the horizontal scan period of its subsequent line, which method is used as the drive method in a liquid crystal display device employing the N-line inversion method. However, the method for lengthening the horizontal scan period of a line immediately after polarity inversion so that it is longer than the horizontal scan period of its subsequent line is deficient in effect for preventing lateral stripes from occurring on the liquid crystal display panel 10 described above.

Additionally, although the above-identified Japanese document discloses therein that the horizontal scan period of the line immediately after the polarity inversion is lengthened to 1.1 to 1.4 times longer than the horizontal scan period of its subsequent line, it is no longer possible in cases where the horizontal scan period is short to make the horizontal scan period of the line immediately after polarity inversion significantly longer than the horizontal scan period of its subsequent line.

In view of the fact that the lateral stripes occurring on the liquid crystal display panel 10 are viewable more appreciably for lines that are distant from the drain drivers 130, as stated previously, the method as taught by the above Japanese document is incapable of preventing both the lateral stripes occurring at lines near the drain drivers 130 and the lateral stripes occurring at lines far from the drain drivers 130 at the same time. The Japanese document fails to teach or suggest in any way a technique for preventing both the lateral stripes occurring at lines that are near the drain drivers 130 and the lateral stripes occurring at lines that are distant from the drain drivers 130.

It should be noted that, although in the above explanation, specific embodiments have been described in which the present invention is applied to liquid crystal display panels of the type employing longitudinal electric field schemes, this invention should not be limited only to these embodiments and may alternatively be applied to liquid crystal display panels of the type using lateral electric field schemes.

In the longitudinal electric field type of liquid crystal display panel shown in FIG. 2 or 3, the common electrode (ITO2) is provided on or above a substrate opposing the TFT substrate. In contrast, with the lateral electric field type of liquid crystal display panels, an opposite or "counter" electrode (CT) and its associative counter electrode signal line (CL) for applying a common voltage (Vcom) to the counter electrode (CT) are provided on the TFT substrate.

Due to this, a liquid crystal capacitance (Cpix) is equivalently connected between a pixel electrode (PX) and the counter electrode (CT). Additionally. a storage capacitor (Cstg) is formed between the pixel electrode (PX) and the counter electrode (CT).

Also, note that, in the individual embodiments described above, an embodiment employing the multiple-line inversion method as a driving method has been explained. The present invention should not exclusively be limited thereto and may alternatively be applicable to embodiments using the common inversion method for inverting the drive voltages which are applied to the pixel electrode (ITO1) and common electrode (ITO2) on a per-multiline basis.

Although the present invention made by the inventors as named herein has been explained in detail based on representative embodiments thereof, it should be appreciated that this invention is not be limited only to such embodiments and may be modified without departing from the spirit and scope of the invention.

A brief explanation of the effect obtainable by a representative one of the inventive concepts as disclosed herein is as follows.

In accordance with the invention, in the case of driving while inverting the polarity of a gradation voltage for every line N ($N \geqq 2$), it becomes possible to prevent unwanted creation of on-screen lateral stripes, thus enabling improvement in the display quality of a display screen to be displayed on a liquid crystal display device.

What is claimed is:

1. A method of driving an active matrix type of liquid crystal display device having a plurality of pixels and a driver circuit for outputting to each pixel a gradation voltage selected from among M ($M \geqq 2$) gradation voltages, characterized by the steps of:

inverting the polarity of the gradation voltage being outputted from the driver circuit to each pixel for every N ($N \geqq 2$)-line group and every frame; and changing a voltage value of an m ($1 \leqq m \leqq M$)-th gradation voltage to be outputted from the driver circuit to each pixel between when it is being outputted to a pixel on a first line immediately after polarity inversion and when it is being outputted to a pixel on a polarity-noninverted line subsequent to the first line immediately after the polarity inversion;

wherein an absolute value of a difference between the m-th gradation voltage being outputted from the driver circuit to each pixel and a common voltage is greater when it is being outputted from the driver circuit to the pixel on the first line immediately after polarity inversion than when it is being outputted from the driver circuit to the pixel on the polarity-noninverted line.

2. A method of driving an active matrix type of liquid crystal display device according to claim 1, characterized in that an absolute value of a difference between the gradation voltage being outputted from the driver circuit to the pixel on the first line immediately after polarity inversion and the gradation voltage to be outputted from the driver circuit to the pixel on the polarity-noninverted line is different on a per-gradation basis.

3. A method of driving an active matrix type of liquid crystal display device according to claim 2, characterized in that when the absolute value of a difference between the gradation voltage and the common voltage is greater, the absolute value of a difference between the gradation voltage being outputted from the driver circuit to the pixel on the first line immediately after the polarity inversion and the gradation voltage to be outputted from the driver circuit to the pixel on the polarity-noninverted line is greater.

4. A method of driving an active matrix type of liquid crystal display device according to claim 1, characterized in that when the distance between a line being scanned and the driver circuit is greater, the absolute value of a difference between the m-th gradation voltage being outputted from the driver circuit to the pixel on the first line immediately after the polarity inversion and the m-th gradation voltage to be outputted from the driver circuit to the pixel on the polarity-noninverted line is greater.

5. A method of driving an active matrix type of liquid crystal display device according to claim 1, characterized in that a horizontal scan time period of the line is different between when outputting a gradation voltage from the drive circuit to the pixel on the first line immediately after the polarity inversion and when outputting a gradation voltage from the drive circuit to the pixel on the polarity-noninverted line.

6. A method of driving an active matrix type of liquid crystal display device according to claim 1, characterized in that the polarity of the gradation voltage to be outputted from the drive circuit to each pixel is inverted for every two-line group.

7. A method of driving an active matrix type of liquid crystal display device according to claim 1, wherein each of the plurality of pixels includes at least one thin film transistor, and the upper limit value of M and N is a value which is sufficient so as to enable display by the active matrix type of liquid crystal display device.

8. A method of driving an active matrix type of liquid crystal display device having a plurality of pixels, a drive circuit for outputting a gradation voltage to each pixel, and a power supply circuit for supplying K ($K \geqq 2$) gradation reference voltages to the drive circuit, characterized by the steps of:

inverting the polarity of a gradation voltage being outputted from the drive circuit to each pixel for every N ($N \geqq 2$)-line group and every frame; and changing a voltage value of a k ($1 \leqq k \leqq K$)-th gradation reference voltage being supplied from the power supply circuit to the drive circuit between when outputting a gradation voltage from the drive circuit to the pixel on a first line immediately after polarity inversion and when outputting a gradation voltage from the drive circuit to the pixel on a polarity-noninverted line subsequent to the first line immediately after the polarity inversion;

wherein an absolute value of a difference between the k-th gradation reference voltage being supplied from the power supply circuit to the drive circuit and a common voltage is greater when outputting a gradation voltage from the drive circuit to the pixel on the first line immediately after the polarity inversion than when outputting from the drive circuit to the pixel on the polarity-noninverted line.

9. A method of driving an active matrix type of liquid crystal display device according to claim 8, characterized in that a voltage value of a gradation reference voltage from 1 up to a (K–1)th one is made different between when outputting a gradation voltage from the drive circuit to the pixel on the first line immediately after the polarity inversion and when outputting a gradation voltage from the drive circuit to the pixel on the polarity-noninverted line.

10. A method of driving an active matrix type of liquid crystal display device according to claim 8, characterized in that an absolute value of a difference between the gradation reference voltage supplied from the power supply circuit to the drive circuit when outputting a gradation voltage from the drive circuit to the pixel on the first line immediately after the polarity inversion and the gradation reference voltage supplied from the power supply circuit to the drive circuit when outputting from the drive circuit to the pixel on the polarity-noninverted line is different with respect to each gradation reference voltage.

11. A method of driving an active matrix type of liquid crystal display device according to claim 10, characterized in that when the absolute value of a difference between the gradation reference voltage and the common voltage is greater, the absolute value of a difference between the gradation reference voltage to be supplied from the power supply circuit to the drive circuit when outputting a gradation voltage from the drive circuit to the pixel on the first line immediately after the polarity inversion and the gradation reference voltage to be supplied from the power supply circuit to the drive circuit when outputting a gradation voltage from the drive circuit to the pixel on the polarity-noninverted line is greater.

12. A method of driving an active matrix type of liquid crystal display device according to claim 8, characterized in that the absolute value of a difference between the k-th gradation reference voltage being supplied from the power supply circuit to the drive circuit when outputting a gradation voltage from the drive circuit to the pixel on the first line immediately after the polarity inversion and the k-th gradation reference voltage supplied from the power supply circuit to the drive circuit when outputting a gradation voltage from the drive circuit to the pixel on the polarity-noninverted line is greater with an increase in a distance between a line to be scanned and the drive circuit.

13. A method for driving an active matrix type of liquid crystal display device according to claim 8, characterized in that a horizontal scan time period of the line is different between when outputting a gradation voltage from the drive circuit to the pixel on the first line immediately after the polarity inversion and when outputting a gradation voltage from the drive circuit to the pixel on the polarity-noninverted line.

14. A method for driving an active matrix type of liquid crystal display device according to claim 8, characterized in that the polarity of the gradation voltage to be outputted from the drive circuit to each pixel is inverted for every two-line group.

15. A method of driving an active matrix type of liquid crystal display device according to claim 8, wherein each of the plurality of pixels includes at least one thin film transistor, and the upper limit value of K and N is a value which is sufficient so as to enable display by the active matrix type of liquid crystal display device.

16. An active matrix type of liquid crystal display device having a plurality of pixels; a drive circuit for outputting to each pixel a gradation voltage selected from among M ($M \geqq 2$) gradation voltages and also for inverting a polarity of a gradation voltage to be outputted to each pixel for every N ($N \geqq 2$)-line group and every frame; and a correction circuit for letting a voltage value of an m ($1 \leqq m \leqq M$)-th gradation voltage to be outputted from the drive circuit to each pixel be different between when outputting it to a pixel on a first line immediately after polarity inversion and when outputting it to a pixel on a polarity-noninverted line subsequent to the first line immediately after the polarity inversion;

wherein the correction circuit corrects the voltage value of the gradation voltage in such a way that an absolute value of a difference between the m-th gradation voltage to be outputted from the drive circuit to each pixel and a common voltage becomes greater when outputting a gradation voltage from the drive circuit to the pixel on the first line immediately after the polarity inversion than when outputting a gradation voltage from the drive circuit to the pixel on the polarity-noninverted line.

17. An active matrix type of liquid crystal display device according to claim 16, characterized in that the correction circuit corrects the voltage value of the gradation voltage in such a way that an absolute value of a difference between a gradation voltage to be outputted from the drive circuit to the pixel on the first line immediately after the polarity inversion and a gradation voltage to be outputted from the drive circuit to the pixel on the polarity-noninverted line is different with respect to each gradation.

18. An active matrix type of liquid crystal display device according to claim 17, characterized in that the correction circuit corrects the voltage value of the gradation voltage in such a way that the absolute value of a difference between the gradation voltage to be outputted from the drive circuit to the pixel on the first line immediately after the polarity inversion and the gradation voltage to be outputted from the drive circuit to the pixel on the polarity-noninverted line becomes greater with an increase in absolute value of a difference between the gradation voltage and the common voltage.

19. An active matrix type of liquid crystal display device according to claim 16, characterized in that the correction circuit corrects the voltage value of the gradation voltage in such a way that the absolute value of a difference between the m-th gradation voltage being outputted from the drive circuit to the pixel on the first line immediately after the polarity inversion and the m-th gradation voltage to be outputted from the drive circuit to the pixel on the polarity-noninverted line becomes greater with an increase in distance between a line to be scanned and the drive circuit.

20. An active matrix type of liquid crystal display device according to claim 16, further having a circuit for causing the line to differ in horizontal scan time period between when outputting a gradation voltage from the drive circuit to the pixel on the first line immediately after the polarity inversion and when outputting a gradation voltage from the drive circuit to the pixel on the polarity-noninverted line.

21. An active matrix type of liquid crystal display device according to claim 16, characterized in that the drive circuit inverts the polarity of a gradation voltage to be outputted to each pixel for every two-line group.

22. An active matrix type of liquid crystal display device according to claim 16, wherein each of the plurality of pixels includes at least one thin film transistor, and the upper limit value of M and N is a value which is sufficient so as to enable display by the active matrix type of liquid crystal display device.

23. An active matrix type of liquid crystal display device having a plurality of pixels; a drive circuit for outputting a gradation voltage to each pixel and for inverting a polarity of the gradation voltage being outputted to each pixel for every N ($N \geqq 2$)-line group and every frame;

a power supply circuit for supplying K ($K \geqq 2$) gradation reference voltages to the drive circuit; and a correction circuit for causing a voltage value of a k ($1 \leqq k \leqq K$)-th gradation reference voltage supplied from the power supply circuit to the drive circuit to be different between when outputting a gradation voltage from the power supply circuit to a pixel on a first line immediately after polarity inversion and when outputting a gradation voltage from the drive circuit to a pixel on a polarity-noninverted line subsequent to the first line immediately after the polarity inversion;

wherein the correction circuit corrects the voltage value of the k-th gradation reference voltage in such a way that an absolute value of a difference between the k-th gradation reference voltage supplied from the power supply circuit to the drive circuit and a common voltage becomes greater when outputting a gradation voltage from the drive circuit to the pixel on the first line immediately after the polarity inversion than when outputting a gradation voltage from the drive circuit to the pixel on the polarity-noninverted line.

24. An active matrix type of liquid crystal display device according to claim 23, characterized in that:

the power supply circuit has a voltage divider circuit for potentially dividing a voltage between a first power supply voltage and a second power supply voltage and for generating the K gradation reference voltages; and the correction circuit has a correction voltage generator circuit for generating a correction voltage and a voltage adder circuit for adding, upon output of a gradation voltage from the drive circuit to the pixel on the first line immediately after the polarity inversion, the correction voltage generated at the correction voltage generator circuit to a k ($1 \leqq k \leqq K$)-th gradation reference voltage to be generated by the voltage divider circuit.

25. An active matrix type of liquid crystal display device according to claim 24, characterized in that the correction voltage generator circuit generates the correction voltage in such a manner that an absolute value of a difference between the k-th gradation reference voltage supplied from the power supply circuit to the drive circuit and a common voltage becomes greater when outputting a gradation voltage from the drive circuit to the pixel on the first line immediately after the polarity inversion than when outputting a gradation voltage from the drive circuit to the pixel on the polarity-noninverted line.

26. An active matrix type of liquid crystal display device according to claim 24, characterized in that the voltage adder circuit has a switch circuit for turning on when outputting a gradation voltage from the drive circuit to the pixel on the first line immediately after the polarity inversion, and an amplifier circuit for receiving the correction voltage supplied thereto through the switch circuit and for adding the correction voltage to the gradation reference voltage.

27. An active matrix type of liquid crystal display device according to claim 24, characterized in that the correction voltage generator circuit has a capacitive element charged by a signal for instructing a time point for start up of line scanning and a resistive element for determination of a discharge time constant of the capacitive element.

28. An active matrix type of liquid crystal display device according to claim 27, characterized in that a capacitance value of the capacitive element and a resistance value of the resistive element are different per each gradation reference voltage.

29. An active matrix type of liquid crystal display device according to claim 28, characterized in that the capacitance value of the capacitive element and the resistance value of the resistive element are set at values in such a manner that the absolute value of a difference between a gradation reference voltage supplied from the power supply circuit to the drive circuit when outputting a gradation voltage from the drive circuit to the pixel on the first line immediately after the polarity inversion and a gradation reference voltage supplied from the power supply circuit to the drive circuit when outputting from the drive circuit to the pixel on the polarity-noninverted line becomes greater with an increase in absolute value of a difference between the gradation reference voltage and the common voltage.

30. An active matrix type of liquid crystal display device according to claim 23, characterized in that:

the power supply circuit has a voltage divider circuit for generating the K gradation reference voltages by potentially dividing a voltage between a first power supply voltage and a second power supply voltage; and the correction circuit has a correction voltage generator circuit for generating a correction voltage and a voltage adder circuit for adding, when letting a gradation reference voltage with a maximum absolute value of a difference between the gradation reference voltage and the common voltage as the K-th gradation reference voltage, the correction voltage being generated at the correction voltage generator circuit to first and (K−1)th gradation reference voltages to be generated by the voltage divider circuit upon output of a gradation voltage from the drive circuit to the pixel on the first line immediately after the polarity inversion.

31. An active matrix type of liquid crystal display device according to claim 30, characterized in that the correction voltage generator circuit generates the correction voltage in such a manner that the absolute value of a difference between the first and (K−1)th gradation reference voltages being supplied from the power supply circuit to the drive circuit and the common voltage becomes greater when outputting a gradation voltage from the drive circuit to the pixel on the first line immediately after the polarity inversion than when outputting a gradation voltage from the drive circuit to the pixel on the polarity-noninverted line.

32. An active matrix type of liquid crystal display device according to claim 23, further having a circuit for causing the line to differ in horizontal scan time period between when outputting a gradation voltage from the drive circuit to the pixel on the first line immediately after the polarity inversion and when outputting a gradation voltage from the drive circuit to the pixel on the polarity-noninverted line.

33. An active matrix type of liquid crystal display device according to claim 23, characterized in that the drive circuit inverts the polarity of a gradation voltage to be outputted to each pixel for every two-line group.

34. An active matrix type of liquid crystal display device according to claim 23, wherein each of the plurality of pixels includes at least one thin film transistor, and the upper limit value of K and N is a value which is sufficient so as to enable display by the active matrix type of liquid crystal display device.

* * * * *